US010932069B2

(12) United States Patent
Jones et al.

(10) Patent No.: US 10,932,069 B2
(45) Date of Patent: Feb. 23, 2021

(54) ACOUSTIC VALVE FOR HEARING DEVICE

(71) Applicant: Knowles Electronics, LLC, Itasca, IL (US)

(72) Inventors: Christopher Jones, Carpentersville, IL (US); Christopher Monti, Elgin, IL (US); Shehab Albahri, Hanover Park, IL (US)

(73) Assignee: Knowles Electronics, LLC, Itasca, IL (US)

( * ) Notice: Subject to any disclaimer, the term of this patent is extended or adjusted under 35 U.S.C. 154(b) by 0 days.

(21) Appl. No.: 16/381,280

(22) Filed: Apr. 11, 2019

(65) Prior Publication Data

US 2019/0320272 A1 Oct. 17, 2019

Related U.S. Application Data

(60) Provisional application No. 62/656,603, filed on Apr. 12, 2018.

(51) Int. Cl.
*H04R 25/00* (2006.01)
*H04R 11/02* (2006.01)

(52) U.S. Cl.
CPC ..... *H04R 25/604* (2013.01); *H04R 11/02* (2013.01); *H04R 25/65* (2013.01); *H04R 2460/09* (2013.01); *H04R 2460/11* (2013.01)

(58) Field of Classification Search
CPC ..... H04R 25/60; H04R 25/65; H04R 9/025; H04R 9/027

(Continued)

(56) References Cited

U.S. PATENT DOCUMENTS 2,301,744 A 5/1941 Olsen
3,835,263 A 9/1974 Killion
(Continued)

FOREIGN PATENT DOCUMENTS

CN 1130459 A 9/1996
DE 2614579 A1 10/1977
(Continued)

OTHER PUBLICATIONS

European Patent Office; Extended European Search Report; EP Application No. 09819815.3; dated Jul. 25, 2013.
(Continued)

*Primary Examiner* — Suhan Ni
(74) *Attorney, Agent, or Firm* — Faegre Drinker Biddle & Reath LLP

(57) ABSTRACT

Acoustic valves include a housing having an acoustic inlet, an acoustic outlet, and an acoustic passage between the inlet and the outlet. An electrical coil is disposed in the housing and configured to generate a magnetic field when energized by an actuation signal. A spring is coupled to an armature movably disposed in the housing between a first surface and a second surface. The valve has a first stable state wherein the armature is positioned against one surface when the electrical coil is not energized, and the valve has a second stable state wherein the armature is positioned against the other surface when the electrical coil is not energized. The armature is movable between the first and second states when the electrical coil is energized, wherein the acoustic passage is more obstructed when the armature is in one state than when the armature is in the other state.

20 Claims, 26 Drawing Sheets

(58) Field of Classification Search
USPC ..... 381/322, 324, 417–418
See application file for complete search history.

(56) References Cited

U.S. PATENT DOCUMENTS

| | | | |
|---|---|---|---|
| 3,836,732 | A | 9/1974 | Johanson et al. |
| 3,876,749 | A | 4/1975 | Horvath et al. |
| 3,975,599 | A | 8/1976 | Johanson |
| 4,133,984 | A | 1/1979 | Akiyama |
| 4,142,072 | A | 2/1979 | Berland |
| 4,605,197 | A | 8/1986 | Casey |
| 4,756,312 | A | 7/1988 | Epley |
| 4,800,982 | A | 1/1989 | Carlson |
| 4,867,267 | A | 9/1989 | Carlson |
| 4,893,655 | A | 1/1990 | Anderson |
| 5,033,090 | A | 7/1991 | Weinrich |
| 5,068,901 | A | 11/1991 | Carlson |
| 5,220,612 | A | 6/1993 | Tibbetts et al. |
| 5,259,035 | A | 11/1993 | Peters et al. |
| 5,349,986 | A | 9/1994 | Sullivan et al. |
| 5,357,576 | A | 10/1994 | Arndt |
| 5,524,056 | A | 6/1996 | Killion et al. |
| 5,631,965 | A | 5/1997 | Chang |
| 5,692,060 | A | 11/1997 | Wickstrom |
| 5,757,933 | A | 5/1998 | Preves et al. |
| 5,785,661 | A | 7/1998 | Shennib |
| 5,835,608 | A | 11/1998 | Warnaka et al. |
| 5,990,425 | A | 11/1999 | McSwiggen |
| 6,068,079 | A | 5/2000 | Hamery et al. |
| 6,075,869 | A | 6/2000 | Killion et al. |
| 6,134,334 | A | 10/2000 | Killion et al. |
| 6,151,399 | A | 11/2000 | Killion et al. |
| 6,549,635 | B1 | 4/2003 | Gebert |
| 7,136,497 | B2 | 11/2006 | McSwiggen |
| 7,458,395 | B2 | 12/2008 | Haynes et al. |
| 7,478,702 | B2 | 1/2009 | Berg |
| 7,548,629 | B1 | 6/2009 | Griffin |
| 7,740,104 | B1 | 6/2010 | Parkins |
| 7,784,583 | B1 | 8/2010 | Hall |
| 8,096,383 | B2 | 1/2012 | Saltykov |
| 8,199,955 | B2 | 6/2012 | Akino |
| 8,338,898 | B2 | 12/2012 | Schrank et al. |
| 8,391,527 | B2 | 3/2013 | Feucht |
| 8,798,304 | B2 | 8/2014 | Miller et al. |
| 8,923,543 | B2 | 12/2014 | Sacha |
| 9,185,480 | B2 | 11/2015 | Howes |
| 9,525,929 | B2 | 12/2016 | Burgett |
| 9,706,290 | B2 | 7/2017 | Grinker |
| 2003/0059075 | A1 | 3/2003 | Niederdrank |
| 2004/0046137 | A1 | 3/2004 | Herbert et al. |
| 2006/0108552 | A1 | 5/2006 | Herbert et al. |
| 2006/0137934 | A1 | 6/2006 | Kurth |
| 2007/0075284 | A1 | 4/2007 | Masamura et al. |
| 2007/0086599 | A1 | 4/2007 | Wilmink |
| 2007/0176720 | A1 | 8/2007 | Janssen et al. |
| 2008/0181443 | A1 | 7/2008 | Harvey et al. |
| 2010/0111340 | A1 | 5/2010 | Miller et al. |
| 2011/0182453 | A1 | 7/2011 | Van Hal |
| 2012/0082335 | A1 | 4/2012 | Duisters |
| 2014/0169579 | A1 | 6/2014 | Azmi |
| 2014/0169603 | A1 | 6/2014 | Sacha et al. |
| 2015/0041931 | A1 | 2/2015 | Szczech et al. |
| 2016/0150310 | A1 | 5/2016 | Bakalos |
| 2016/0255433 | A1* | 9/2016 | Grinker ..... H04R 1/1016 381/380 |
| 2017/0055086 | A1 | 2/2017 | van Gilst |
| 2017/0208382 | A1 | 7/2017 | Grinker |
| 2017/0251292 | A1 | 8/2017 | Wiederholtz |
| 2018/0091892 | A1 | 3/2018 | Taylor |
| 2018/0109862 | A1 | 4/2018 | Lawand |
| 2019/0116436 | A1 | 4/2019 | Lawland |
| 2019/0116437 | A1 | 4/2019 | Bolsman |
| 2019/0166238 | A1 | 5/2019 | Gilmore |
| 2019/0208301 | A1 | 7/2019 | Monti |
| 2019/0208343 | A1 | 7/2019 | Monti |
| 2019/0215620 | A1 | 7/2019 | Albahri |
| 2019/0215621 | A1 | 7/2019 | Albahri |
| 2019/0320272 | A1 | 10/2019 | Jones |

FOREIGN PATENT DOCUMENTS

| | | | |
|---|---|---|---|
| DE | 4422972 | A1 | 1/1996 |
| EP | 0455203 | A2 | 11/1991 |
| EP | 2747455 | A2 | 6/2014 |
| EP | 3177037 | A2 | 6/2017 |
| EP | 2835987 | | 8/2017 |
| FR | 2596644 | A1 | 10/1987 |
| KR | 10-0517059 | B1 | 9/2005 |
| KR | 1020080001568 | A | 1/2008 |
| WO | 1995007014 | A1 | 3/1995 |
| WO | 1997009864 | A1 | 3/1997 |
| WO | 1997030565 | A1 | 8/1997 |
| WO | 1998047318 | A1 | 10/1998 |
| WO | 1998057081 | A1 | 12/1998 |
| WO | 0027166 | A2 | 5/2000 |
| WO | 2006061058 | A1 | 6/2006 |
| WO | 2007107736 | A2 | 9/2007 |
| WO | 2008022048 | A2 | 2/2008 |
| WO | 2010042613 | A2 | 4/2010 |

OTHER PUBLICATIONS

European Patent Office; Extended European Search Report; EP Application No. 09819815.3; dated Dec. 22, 2016.
International Search Report and Written Opinion; International Application No. PCT/US2009/059829; dated May 20, 2010.
International Search Report and Written Opinion; International Application No. PCT/US2019/063321; dated Mar. 3, 2020.

* cited by examiner

ACOUSTIC VALVE FOR HEARING DEVICE

RELATED APPLICATIONS

This application claims priority to U.S. Provisional Patent Application Ser. No. 62/656,603 filed on Apr. 12, 2018, and entitled "Acoustic Valve for Hearing Device," the entire contents of which is hereby incorporated by reference.

TECHNICAL FIELD

This disclosure relates generally to audio devices and, more specifically, to acoustic valves implemented in audio devices.

BACKGROUND

Audio devices are known generally and include hearing aids, earphones and ear pods, among other devices. Some audio devices are configured to provide an acoustic seal (i.e., a "closed fit") with the user's ear. The acoustic seal may cause other occlusion effects including a sense of pressure build-up in the user's ear, a blocking of externally produced sounds that the user may wish to hear, and a distorted perception of the user's own voice among other negative effects. However, closed-fit devices have desirable effects including higher output at low frequencies and the blocking of unwanted sound from the ambient environment.

Other audio devices provide a vented coupling (i.e., "open fit") with the user's ear. Such a vent allows ambient sound to pass into the user's ear. Open-fit devices tend to reduce the negative effects of occlusion but in some circumstances may not provide optimized frequency performance and sound quality. One such open-fit hearing device is a receiver-in-canal (RIC) device fitted with an open-fit ear tip. RIC devices typically supplement environmental sound with amplified sound in a specific range of frequencies to compensate for hearing loss and aid in communication. The inventors have recognized a need for acoustic valves implemented in hearing devices that can provide the hearing devices with the benefits of both open fit and closed fit.

BRIEF DESCRIPTION OF THE DRAWINGS

The objects, features and advantages of the present disclosure will become more fully apparent to those of ordinary skill in the art upon careful consideration of the following Detailed Description and the appended claims in conjunction with the drawings described below.

Elements in the figures are illustrated for simplicity and clarity and have not necessarily been drawn to scale or to include all features, options or attachments. For example, the dimensions and/or relative positioning of some of the elements in the figures may be exaggerated relative to other elements to help to improve understanding of various embodiments. Also, common but well-understood elements that are useful or necessary in a commercially feasible embodiment are often not depicted in order to facilitate a less obstructed view of these various embodiments. The terms and expressions used herein have the ordinary technical meaning as is accorded to such terms and expressions by persons skilled in the technical field as set forth above except where different specific meanings have otherwise been set forth herein.

DETAILED DESCRIPTION

The present disclosure pertains to acoustic valves to be implemented in hearing devices, wherein the hearing device is configurable in open fit and closed fit configurations at different times through actuation of one or more acoustic valves located in one or more corresponding acoustic passages of the hearing device. The one or more acoustic valves of the hearing device can be adaptively controlled by an electrical control unit based on the inputs from one or more sensors. In one embodiment, the valve is bi-stable so that power is only consumed when the valve changes state. No power is required between state changes. The acoustic valves may be actuatable in situ without having to remove the hearing device from the user's ear thereby enabling the user to experience the benefit of a closed fit or an open fit depending on the user's desire or other context.

The acoustic valves described herein generally comprise a housing having an acoustic inlet, an acoustic outlet, and an acoustic passage between the inlet and the outlet. An electrical coil is disposed in the housing and configured to generate a magnetic field when energized by an actuation signal. A spring is coupled to an armature movably disposed in the housing between a first surface and a second surface.

Figure 1:
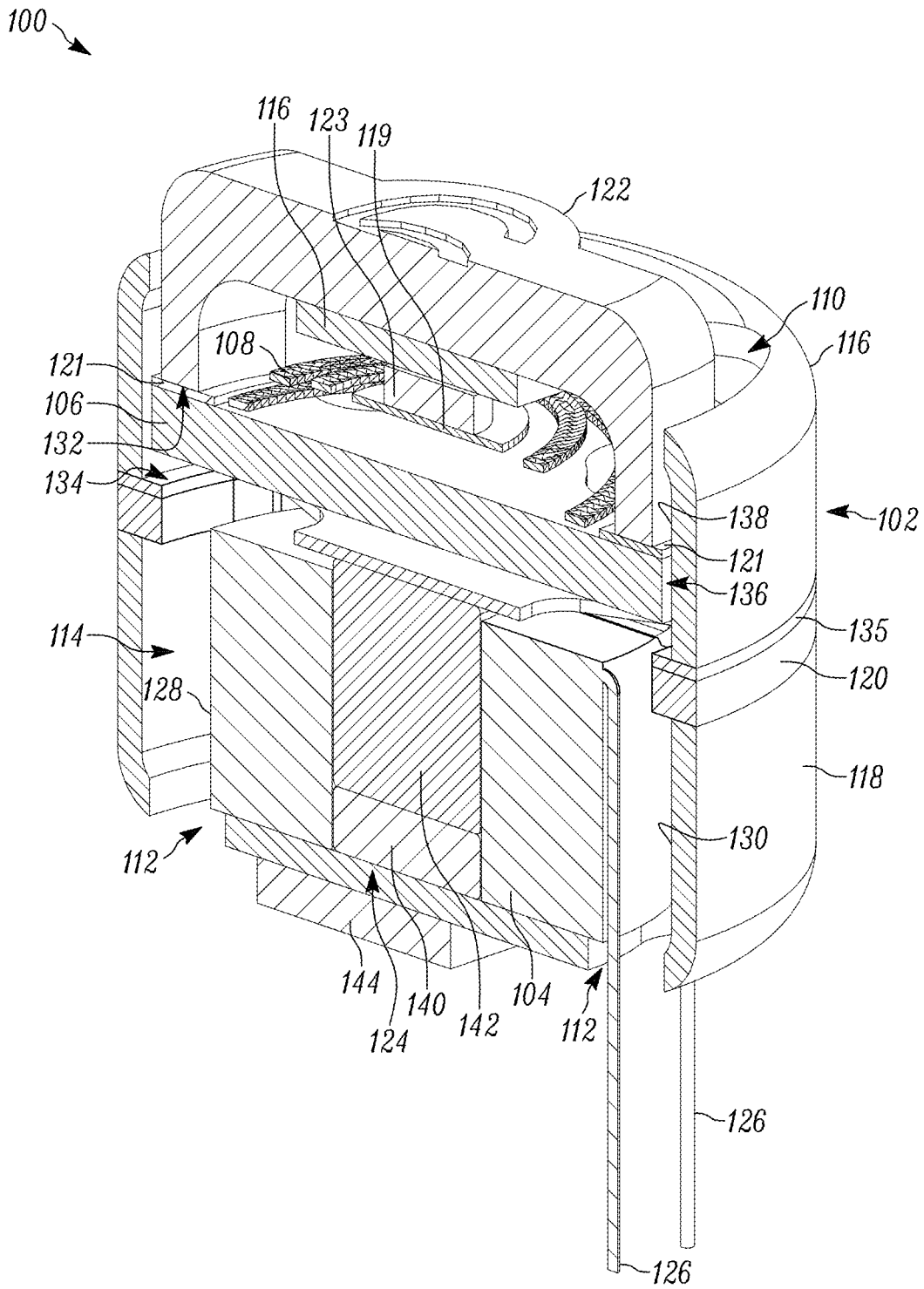
FIG. 1 is a cross-sectional view of an acoustic valve.
Figure 2:
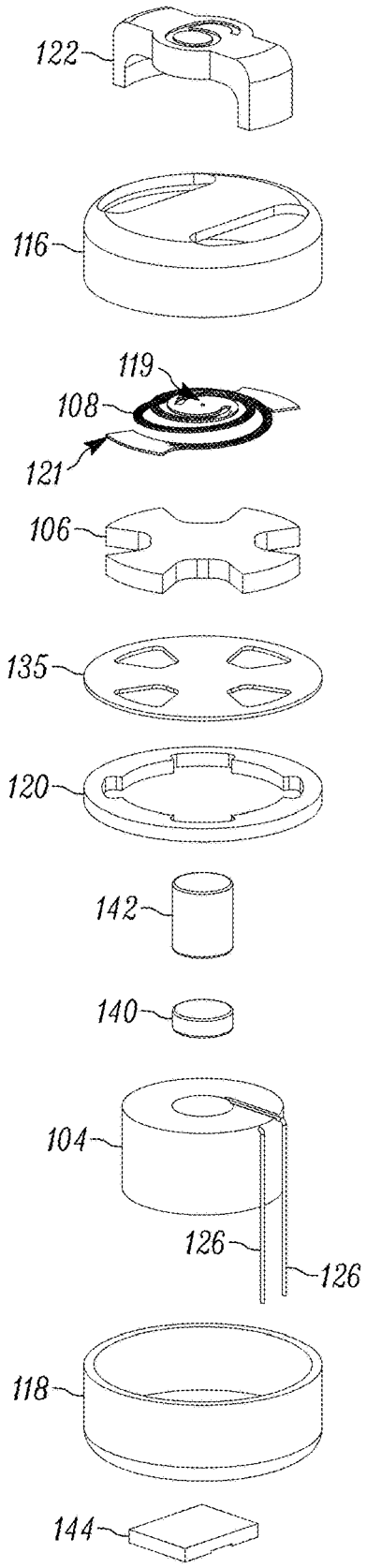
FIG. 2 is an exploded view of the acoustic valve of FIG. 1.
Figure 3:
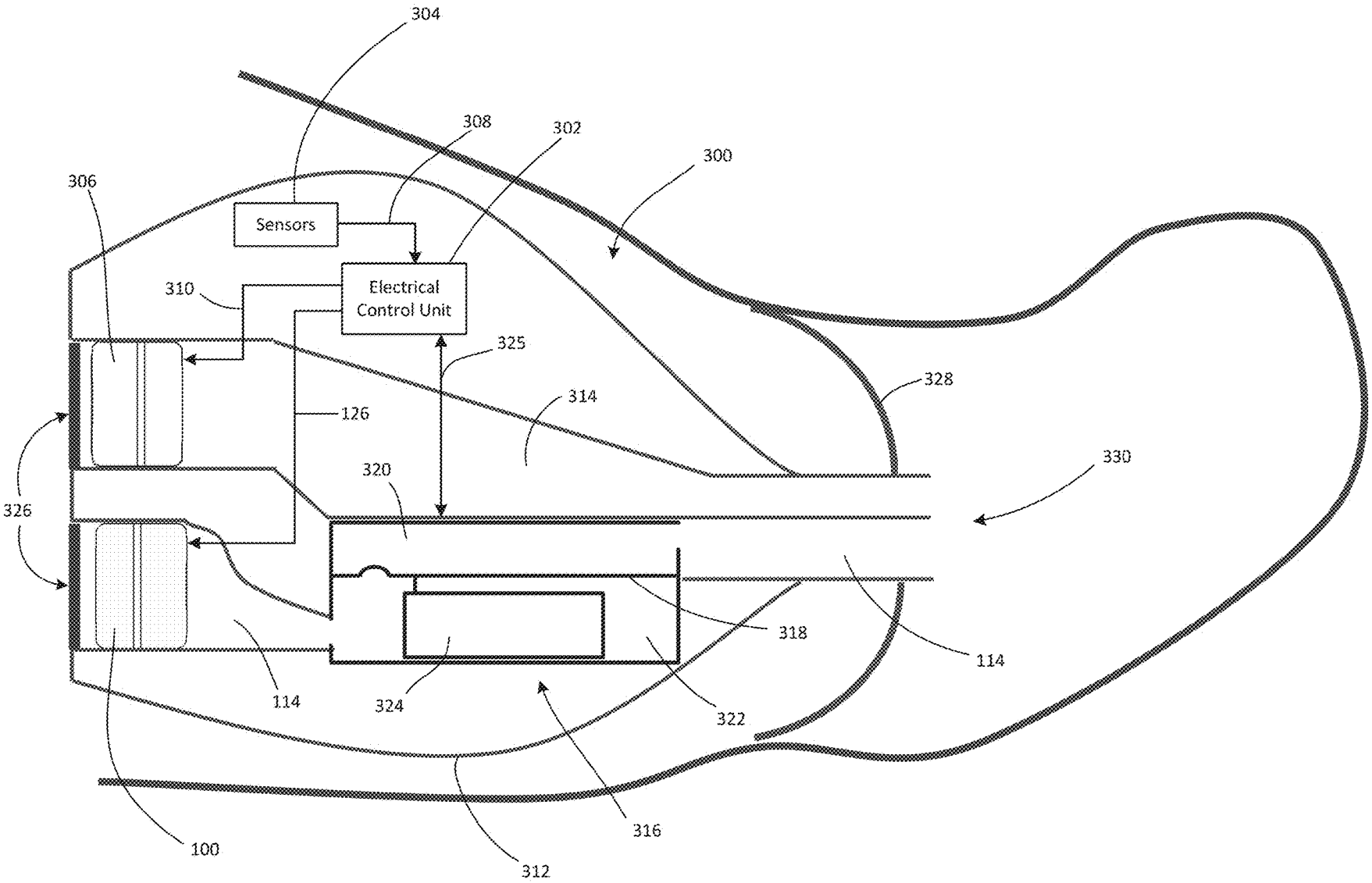
FIG. 3 is a schematic diagram illustrating a hearing device incorporating acoustic valves in different configurations.

The valve has a first stable state wherein the armature is positioned against one surface when the electrical coil is not energized, and the valve has a second stable state wherein the armature is positioned against the other surface when the electrical coil is not energized. As suggested, the armature is movable between the first and second states when the electrical coil is energized, wherein the acoustic passage is more obstructed when the armature is in one state than when the armature is in the other state. Specific implementations and variations on the general form are described further herein. FIGS. 1 and 2 illustrate an acoustic valve 100 and FIG. 3 illustrates a hearing device 300 which uses one or more acoustic valves disclosed herein. In FIG. 1, the acoustic valve 100 includes a housing 102, an electrical coil 104, an armature 106, and a spring 108 coupled to the armature 106. The housing 102 has an acoustic inlet 110, an acoustic outlet 112, and an acoustic passage 114 between the inlet 110 and the outlet 112. Alternatively, for all embodiments described herein, the inlet 110 may be considered the outlet and the outlet 112 may be considered the inlet. Sound travels from the acoustic inlet 110 into the acoustic device 100 through the acoustic passage 114 and exits through the acoustic outlet 112 into the inside of the hearing device implementing the acoustic valve 100. Sound can also travel from the acoustic outlet to the acoustic inlet, for example when sounds originate from within the user's ear canal.

In FIG. 1, the housing 102 includes a cover 116, a cup 118 which at least partially defines the acoustic outlet. A ring 120 and spacer 135 are placed between the cover 116 and the cup 118. The spring 108 is mounted between the cover 116 and the armature 106. The spring 108 can be made from a flat sheet of any suitable material, like metal or plastic. A stop 122 mounted on the cover 116 through the acoustic inlet 110 acts as a stopper for the armature 106 when the spring force exceeds the magnetic force on the armature. Also, the stop and the cover at least partially define the acoustic inlet. A portion 119 of the spring 108 is attached to an optional shim 123 connected to the cover 116 and the feet 121 of the spring are attached to the armature 106 by a weld, glue or other coupling mechanism. The optional shim 123 may be used to adjust the position of the spring relative to the cover.

The cover is made from a non-ferromagnetic metal, for example, an austenitic stainless steel, plastic, or carbon fiber among other materials. In some embodiments, the performance of the acoustic valve may be improved by forming the cup and ring of a ferromagnetic material like steel or a high permeability ferromagnetic material, such as 50% iron/nickel alloy as described herein.

The electrical coil 104, located in the cup 118 of the acoustic valve between the bottom of the cup and the armature 106, has a magnetic core 124 in the center, or passage, of the coil 104. The coil 104 generates a magnetic field when energized by an electrical actuation signal received from an outside source through wires 126 extending from the coil. The wires pass through a port in the housing or through the inlet or outlet and connect to a control unit that provides the actuation signal to the coil. In some embodiments, the coil wires are attached to an electrical terminal, for example a terminal 144 in FIGS. 1 and 2, on an exterior of the housing. FIG. 3 shows a control unit 302 as part of a hearing device 300. Alternatively, the control unit can be located in a behind the ear (BTE) unit or in a host device like a cellphone, PC, tablet or other device. Energizing the coil causes the valve to change from one state to another state thereby opening or closing the valve. In FIGS. 1 and 2, the outer surface 128 of the electrical coil 104 and an inner surface 130 of the housing 102 at least partially define the acoustic passage 114 where sound and air passes through the valve in the open state.

In FIG. 1, the armature 106 is movably disposed in the housing between a stop surface 132 and a sealing surface 134. A portion of the stop 122 defines the stop surface 132, and a surface of a spacer 135 disposed between the cover 116 and the ring 120 defines the sealing surface 134. As such, when the electrical coil 104 is energized, the magnetic field causes the armature 106 to transition to one of two states. In one state the armature 106 is seated on the stop surface 132 and the valve is open and in the other state the armature is seated on the sealing surface 134 and the valve is closed. FIG. 2 shows complementary and overlapping portions of the armature 106 and spacer 135 that cooperate to open and close valve. A narrow gap 136 between a peripheral portion of the armature 106 and the sidewall 138 limits excessive non-axial or lateral movement of the armature that may strain the spring 108, for example, when the acoustic valve experiences shock due to an impact.

The electrical coil 104 is wound or otherwise disposed around the magnetic core 124. The magnetic core includes a permanent magnet 140 and a pole piece 142 attached to the magnet 140. The pole piece is made of high permeability ferromagnetic material, such as 50% iron/nickel alloy. The ring 120 can also be made of ferromagnetic material to improve the magnetic efficiency of the coil 104 by providing a high permeability path for the magnetic flux. In another embodiment, the magnetic core can be formed entirely of a permanent magnet, without a pole piece, or instead of a permanent magnet the core can be formed of only hard ferromagnetic material with a high coercive force. Furthermore, the relative positions of the magnet and the pole in the magnetic core are interchangeable, i.e., the magnet can be on top of the pole or vice versa.

The acoustic valve has an open state and a closed state depending on the position of the armature. In the open state, the armature 106 is positioned against the stop surface 132 wherein sound and air pass freely through the acoustic passage 114. In the closed state, the armature 106 is positioned against the sealing surface 134 wherein the armature 106 obstructs the passage of sound or air through the acoustic passage 114. In FIGS. 1 and 2, the acoustic passage extends around the periphery and through recesses of the armature 106 when the valve is open.

In FIGS. 1-2 and 4-19, the permanent magnet and the spring exert forces in opposite directions, wherein the armature is retained in one state by the spring force and in the other state by the magnetic force depending on the predominant force. In the absence of a coil induced magnetic field, the permanent magnet force exceeds the spring force when the armature is positioned near the core, and the spring force exceeds the magnetic force when the armature is positioned away from the core. In some embodiments, the spring force retains the armature in the open state and the magnetic force retains the armature in the closed state. In other embodiments, however, the spring force may retain the armature in the closed state and the magnetic force may retain the armature in the open state. A magnetic field induced by the coil can either add to, or subtract from, the magnetic field of the permanent magnet, depending on the polarity of the actuation signal applied to the coil. An increased magnetic force will exceed the spring force and cause the armature to change states in one direction. Conversely, the spring force will exceed a decreased magnetic force and cause the armature to change states in the other direction. Thus a momentary increase or decrease in the overall magnetic field of sufficient magnitude and duration will change the position of the armature and the state of the valve. In these embodiments, the spring is pre-loaded so that a spring force is applied to the armature in both states.

The armature is made of a ferromagnetic material to enable the magnetic core to exert an attractive magnetic force on the armature. The shape and size of the armature and the sealing surface are designed to complement each other such that, when overlapped, the armature and the sealing surface significantly obstruct the acoustic passage. For example, the armature can have an acoustic passage through a central portion thereof, or about the periphery thereof, or one or more other apertures located between the central and peripheral portions of the armature. These and other aspects of the armature are described further herein. The shape and size of the armature may vary depending on how the spring is mounted in the valve, as well as other requirements.

In the example as illustrated in FIG. 3, the hearing device 300 uses two acoustic valves 100 and 306 which are both controlled by the electrical control unit 302. The sensors 304 detect changes in the condition of the hearing device 300 which may require a change in the state of the valves 100 and 306. Upon detection of such changes, the sensors 304 send sensor input 308 to the electrical control unit 302 which then decides whether to change the state of the valves. The electrical control unit 302 can be any suitable data processing unit which processes sensor input 308 to make the decision. After making the decision, the electrical control unit 302 sends an actuation signal to the first valve 100 through the set of wires 126, and to the second valve 306 through a second set of wires 310. Each wire leads to the electrical coil of the respective valve. Although FIG. 3 illustrates the sensors 304 as being inside a device housing 312 of the hearing device 300, such sensors can also be implemented outside the hearing device and connected to the electrical control unit by a wire or wirelessly, as appropriate. For example, the sensor could be on a BTE unit or in a host device.

Examples of the sensors used in the hearing device as disclosed herein include microphones, touch sensors, accelerometers, differential pressure sensors, and any other suitable condition-sensing devices. The hearing device 300 includes two valves 100 and 306 such that the second valve 306 acoustically couples to a vent path 314 independent of the acoustic passage 114, and the first valve 100 acoustically couples to a sound-producing electro-acoustic transducer 316. The transducer 316 includes a diaphragm 318 separating the volume inside the transducer 316 into a front volume 320 and a back volume 322, with a motor 324 disposed in the back volume 322. The transducer 316 is coupled to the electrical control unit 302 such that electrical signal 325 can travel between the electrical control unit 302 and the transducer 316. Transducers suitable for the embodiments described herein include but are not limited to balanced armature receivers and dynamic speakers. Balanced armature receivers are available from Knowles Electronics, LLC.

In FIG. 3, the hearing device 300 includes filters 326 mounted on the device housing 312 on the side of the acoustic valves 100 and 306 acoustically coupled to the ambient atmosphere. The filters 326 at least partially inhibit the migration contamination which might include wax, particulate matter, fluid, vapor and other debris into the hearing device. The filters 326 can be mounted externally or internally to the device 300 as is appropriate for easy replacement, improved aesthetics, or to protect them from damage. The hearing device 300 also includes an ear tip 328 which forms a substantial acoustic seal to the ear canal once the hearing device 300 is at least partially inserted into the ear canal. The ear tip 328 is coupled to a sound output 330 through which sound enters the ear canal. The ear tip 328 may be made of any material as deemed suitable for the use of the hearing device, including but not limited to foams, silicone, plastic, or rubber. Any suitable ear tips of various shapes may be employed, such as double- or triple-flanged ear tips, as appropriate, in order to provide a more isolating or more reliable acoustic seal for the user while the hearing device is at least partially inserted inside the ear canal. The ear tip may also be integral to the housing and may be custom molded to the shape of a user's ear. Any other suitable configurations may be used.

Figure 4:
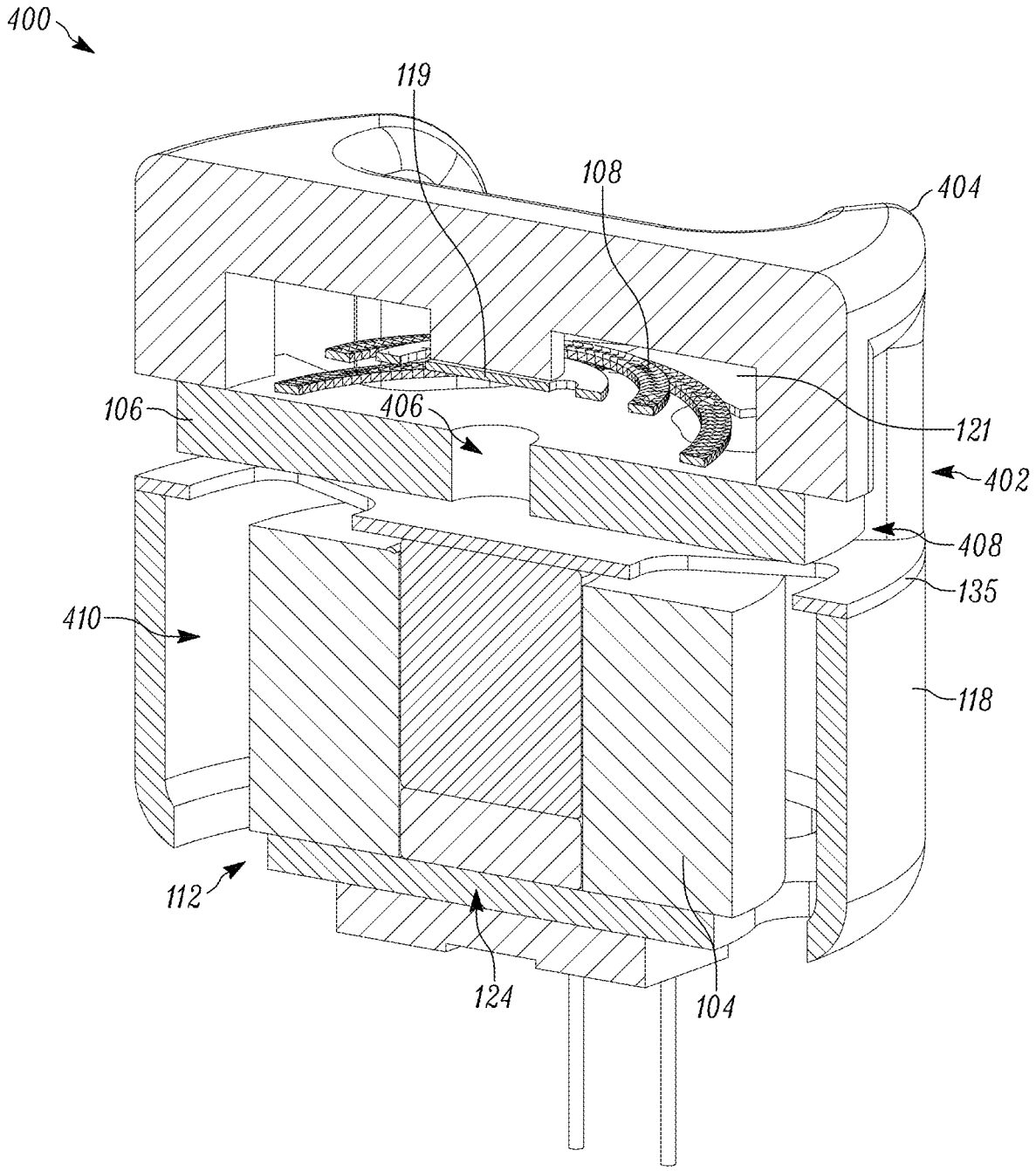
FIG. 4 is a cross-sectional view of an acoustic valve.
Figure 5:
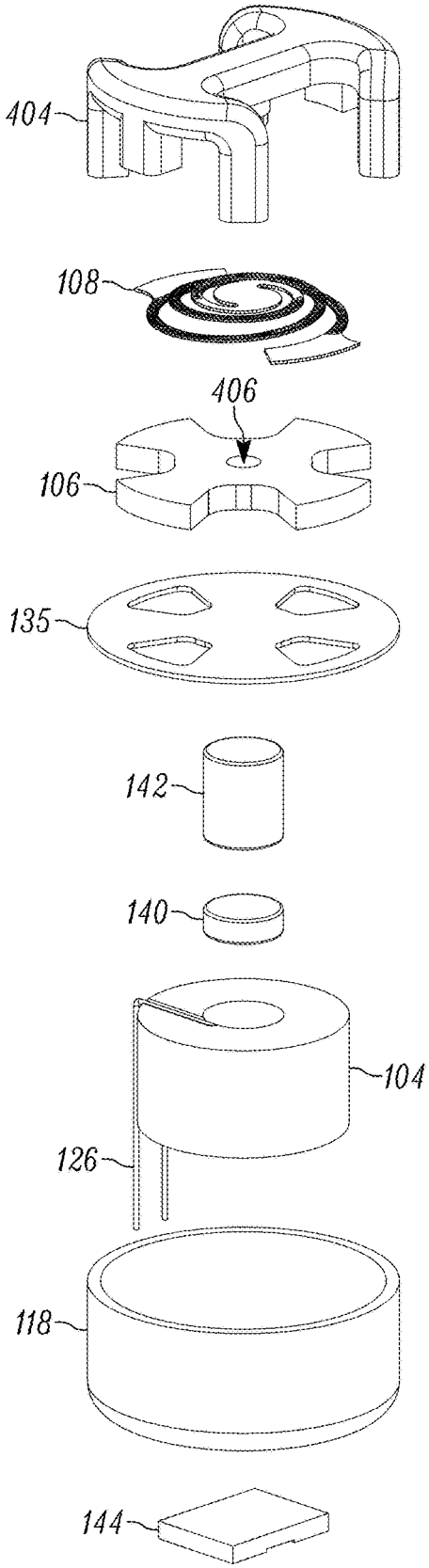
FIG. 5 is an exploded view of the acoustic valve of FIG. 4.

FIGS. 4 and 5 illustrate an acoustic valve 400 wherein at least some of the cover, stop, and shim are integrated into a single-piece cover. The housing 402 of the valve 400 includes a cover 404 and the cup 118, with the spacer 135 placed between the cover 404 and the cup 118. The cup 118 contains the electrical coil 104 and the magnetic core 124. The center portion 119 of the spring 108 attaches to the cover 404 and the feet 121 attach to the armature 106. An acoustic inlet 408 is at least partially defined by the cover 404. In the open state, sound and air are free to flow around the periphery and through the aperture 406 of the armature 106. The aperture through the armature also facilitates assembly of the spring with the cover. The cover is made of plastic, for example, or other suitable material. An optional ferromagnetic ring can be included between the cover and the cup to improve magnetic efficiency of the coil as described in connection with the embodiment of FIGS. 1 and 2.

Figure 6:
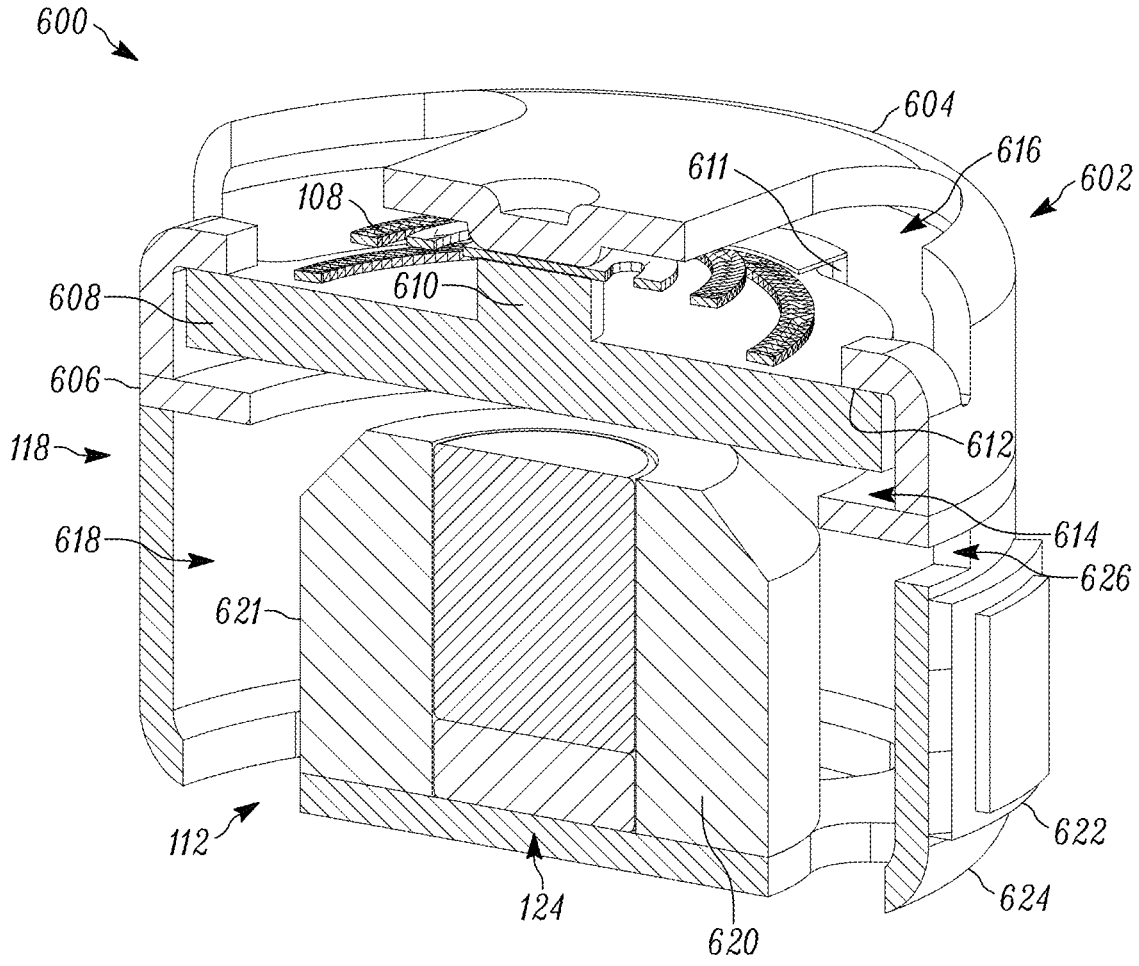
FIG. 6 is a cross-sectional view of an acoustic valve.
Figure 7:
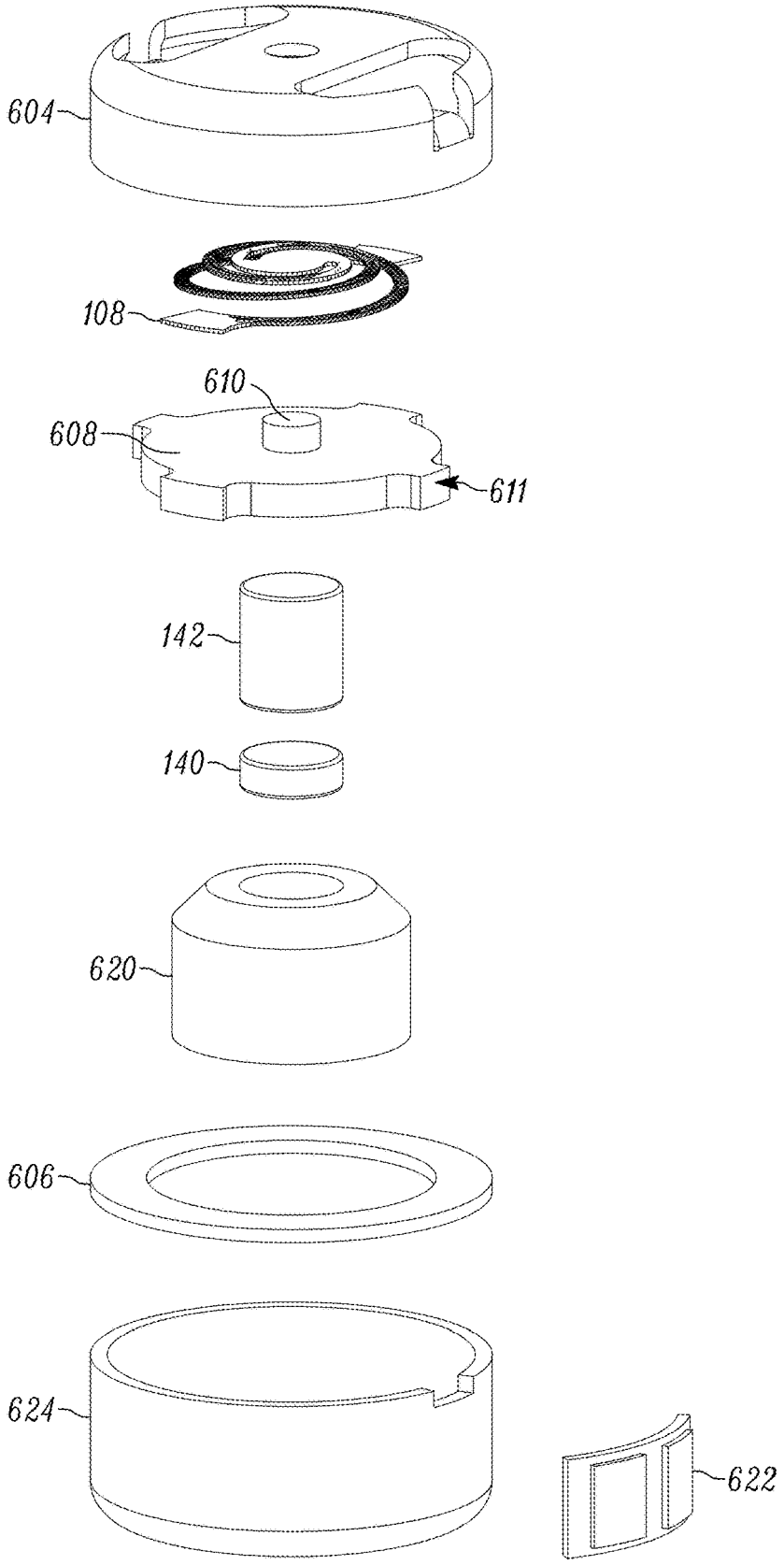
FIG. 7 is an exploded view of the acoustic valve of FIG. 6.

FIGS. 6 and 7 illustrate another acoustic valve 600 wherein the armature has a protrusion, the ring overlaps with the armature and the coil has a conical end portion with fewer windings. A housing 602 of the valve 600 includes a cover 604 and the cup 118, with a ring 606 placed between the cover 604 and the cup 118. The armature 608 is movably disposed between portions of the cover 604 and a sealing surface 614 of the ring 606. The central portion of the spring 108 is coupled to the cover 604 and the peripheral portion of the spring is coupled to the armature 608, wherein the spring is pre-loaded in both the open and closed states. The cover 604 includes a central portion and protrusions 612 that act as stops upon engagement with protrusion 610 and peripheral portions of the armature, respectively. A plurality of arms 611 extending from the side of the armature 608 limit non-axial or lateral movement of the armature to prevent damage to the spring. The parts of the valve 600 can be made from materials as described in connection with the embodiment in FIGS. 1 and 2.

In FIG. 6, an acoustic inlet 616 is at least partially defined by the cover 604. The spring 108 holds the armature 608 against the stop surface 612 of the cover 604 in the open state. Alternatively, when the magnetic core 124 holds the armature 608 against the sealing surface 614 in the closed state, the armature 608 and the sealing surface 614 substantially obstruct the acoustic passage extending through the valve. An electrical coil 620 placed within the cup 118 is selectively wound for fewer turns around the magnetic core 124 at the end closer to the armature 608 for better air flow through the acoustic passage. An outer surface 621 of the coil and the inner surface 130 of the cup 118 at least partly define the acoustic passage 618. Also, the ring 606 can be made of a high permeability ferromagnetic material to improve the magnetic efficiency of the coil 620, in addition to providing the sealing surface 614 for the closed state. The cup 118 has a terminal 622 attached to an outside surface 624 thereof, where the wires (not shown) pass through an opening 626 in the housing. Alternatively, the ring 606 may be made of a non-magnetic material, such as austenitic stainless steel, as is appropriate for the electromagnetic performance of the valve.

Figure 8:
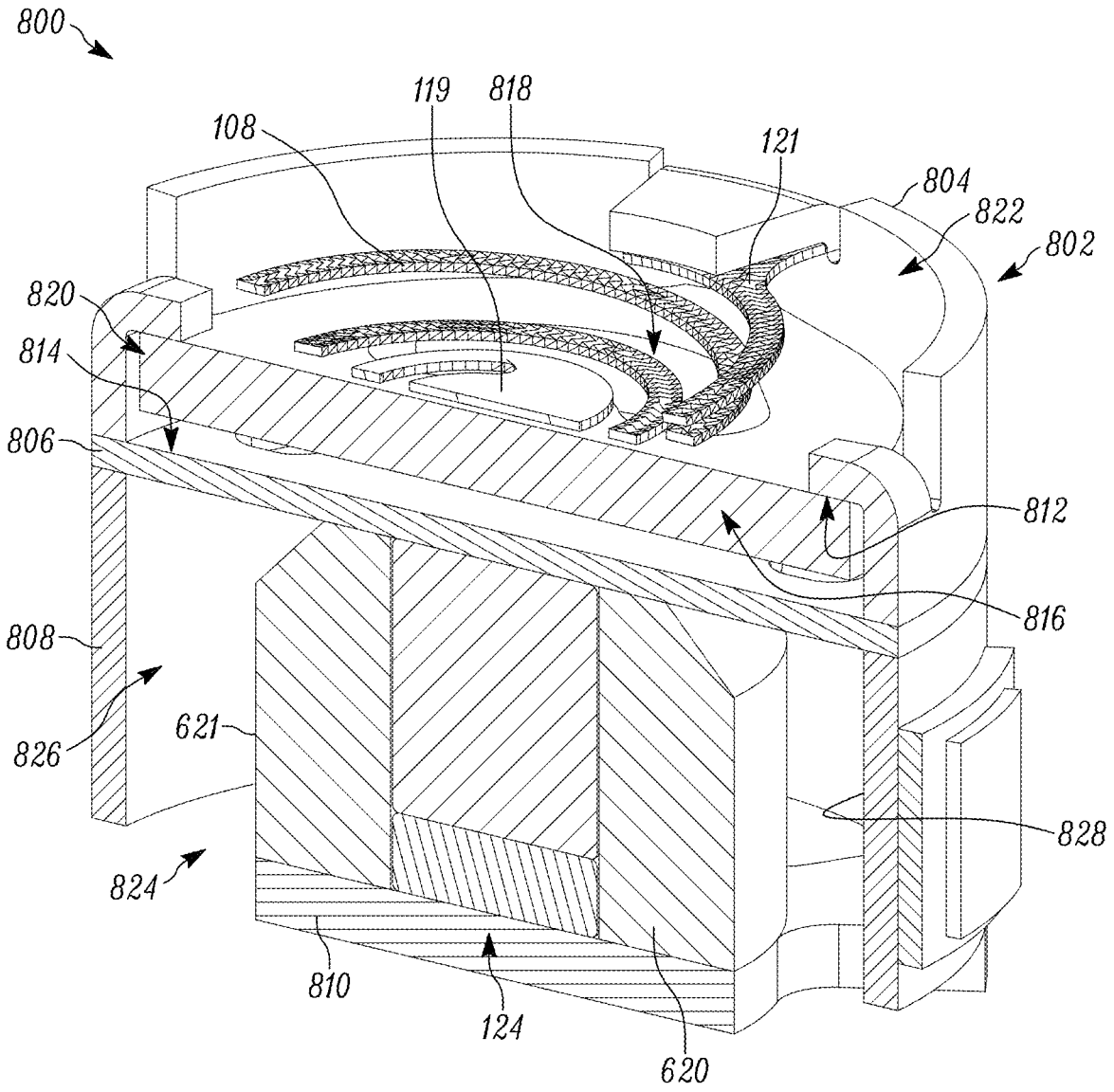
FIG. 8 is a cross-sectional view of an acoustic valve.
Figure 9:
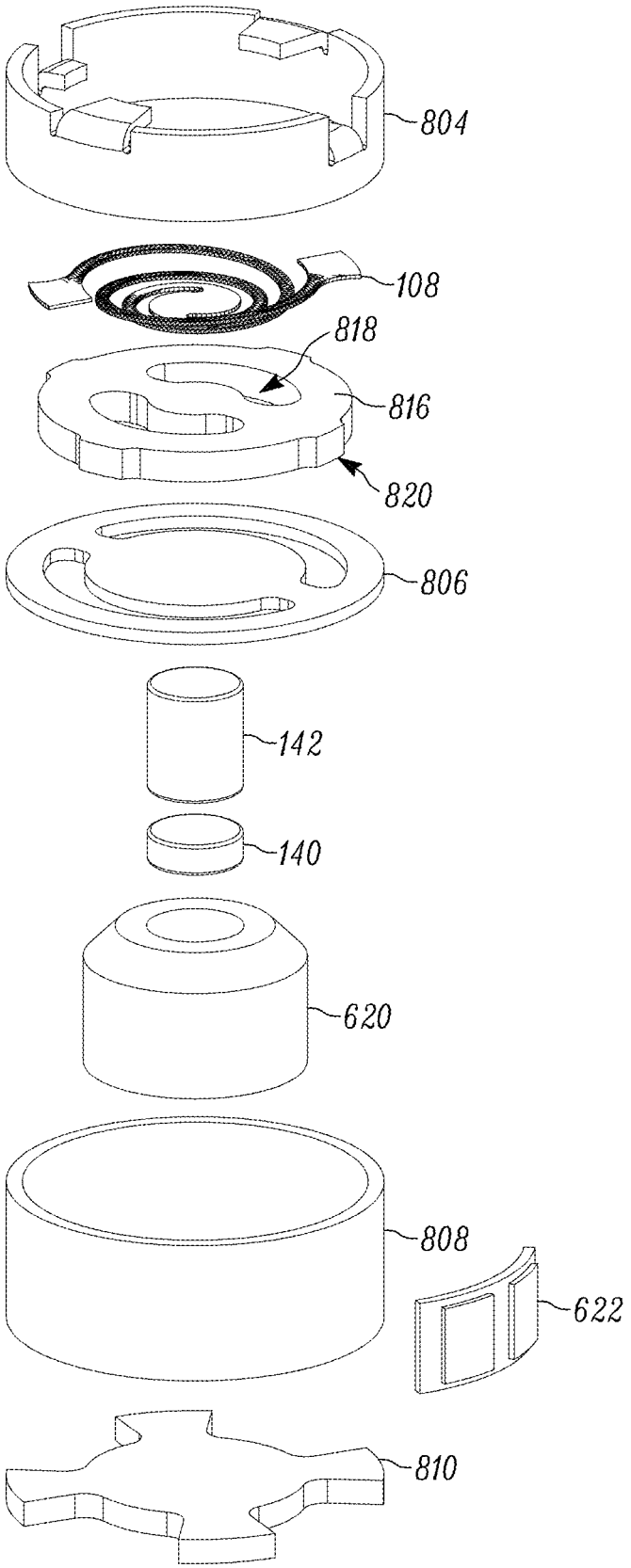
FIG. 9 is an exploded view of the acoustic valve of FIG. 8.

FIGS. 8 and 9 illustrate an acoustic valve 800 having a two-piece cup, the armature has intermediate openings to allow air flow, and the spring is mounted in a reversed position such that the feet of the spring attach to the cover and a center portion of the spring is attached to the armature. A housing 802 of the valve 800 includes a cover 804, a spacer 806, and a cup made of a side piece 808 and a base piece 810. The cover 804 defines a stop surface 812, and the spacer 806 defines a sealing surface 814, between which an armature 816 is movably disposed inside the housing 802. The spacer 806 can be made of any suitable non-magnetic material such as austenitic stainless steel, as is appropriate for the electromagnetic performance of the valve. The center portion 119 of the spring 108 attaches to the armature 816 and the feet 121 attach to the cover 804. The armature 816 has apertures 818 located between the center and the side of the armature 816, with a plurality of arms 820 extending from the side of the armature 816. The electrical coil 620 and the magnetic core 124 are attached to the base piece 810. An acoustic inlet 822 is at least partially defined by the cover 804, an acoustic outlet 824 is at least partially defined by the side piece 808 and the base piece 810 of the cup, and an acoustic passage 826 connecting the inlet 822 and the outlet 824 are at least partially defined by the outer surface 621 of the coil 620 and an inner surface 828 of the side piece 828. Wires (not shown) can pass through the acoustic outlet 824 and extend to the terminal board as described herein.

Figure 10:
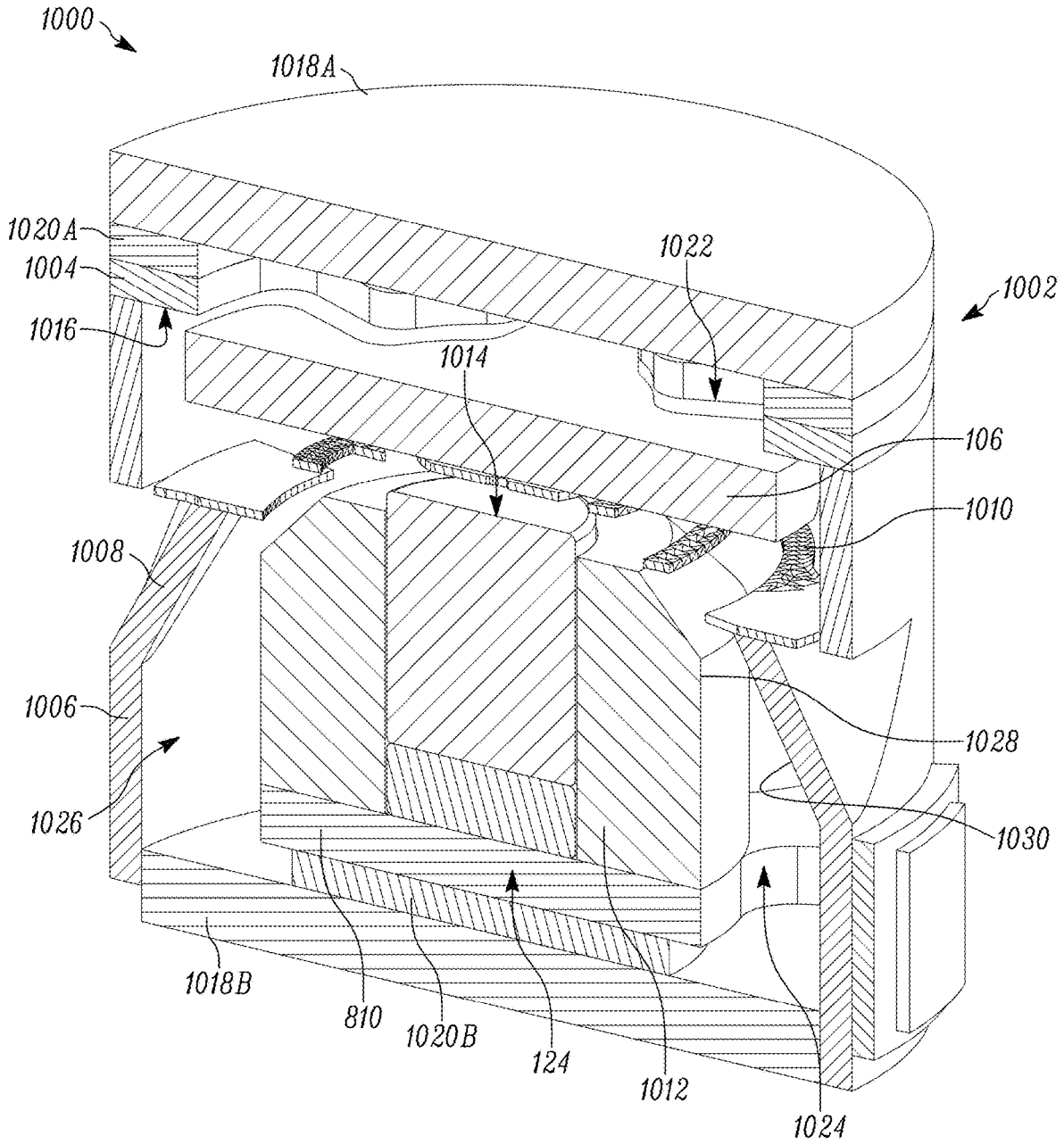
FIG. 10 is a cross-sectional view of an acoustic valve.
Figure 11:
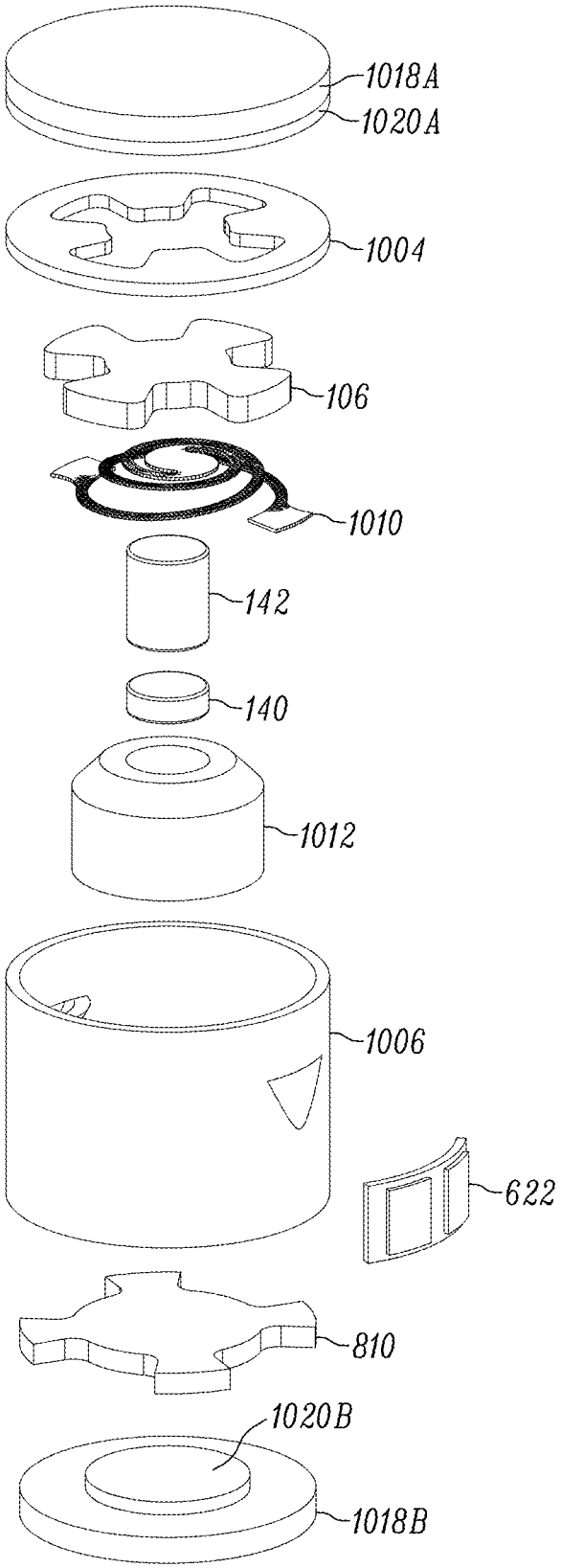
FIG. 11 is an exploded view of the acoustic valve of FIG. 10.

FIGS. 10 and 11 illustrate one example of an acoustic valve 1000 wherein a compression spring is mounted on the same side of the armature as the magnetic core, the two-piece cup has semi-perforations for mounting the spring, and the valve has integral debris barriers. A housing 1002 of the valve 1000 includes a cover or lid 1004 and a cup. The cup is includes a side piece 1006 and a base piece 810. The side piece 1006 has semi-perforations 1008 on which a spring 1010 is mounted, where the spring 1010 is preloaded to exert compression force throughout the range of travel of the armature 106. The spring 1010 is also coupled to the armature 106, which is movably disposed between the spring 1010 and the cover 1004. In this example, the spring 1010 and an electrical coil 1012 is on a common side of the armature 106. The coil 1012 is wound around the magnetic core 124 and shortened to make room for the spring 1010. An upper surface 1014 of the magnetic core 142 and the sealing surface 1016 of the cover 1004 both act as mechanical stops for the armature 106. Debris barriers 1018 are attached on top of the cover 1004 and at the bottom of the base piece 810 using glue 1020 or other suitable methods for fixing the debris barriers 1018 to the valve 1000.

An acoustic inlet 1022 is at least partially defined by the cover 1004, an acoustic outlet 1024 is at least partially defined by the side piece 1006 and the base piece 810, and an acoustic passage 1026 is at least partially defined by an outer surface 1028 of the coil 1012 and an inner surface of the side piece 1030. When the valve 1000 is in the open state, the attractive force of the magnetic core 124 exceeds the compression force of the spring 1010 and the magnetic core 124 holds the armature 106 against the upper surface 1014 of the core. When the valve 1000 is in the closed state, the compression force of the spring 1010 exceeds the attractive force of the magnetic core 124 and the spring 1010 holds the armature 106 against the sealing surface 1016 of the cover 1004. Alternatively, the center of the spring can also act as the stopper for the armature, or an additional suitable spacer component can be added as appropriate. In addition, the cup can be made of ferromagnetic material to improve the magnetic efficiency of the coil. Wires (not shown) can pass through a relief at the bottom of the cup and attach to electrical terminals on an exterior of the housing as discussed herein. The cover and the cup are designed such that when assembled, the valve has a flat top and a flat bottom, which makes it easier to fasten debris barriers on both ends of the valve.

Figure 12:
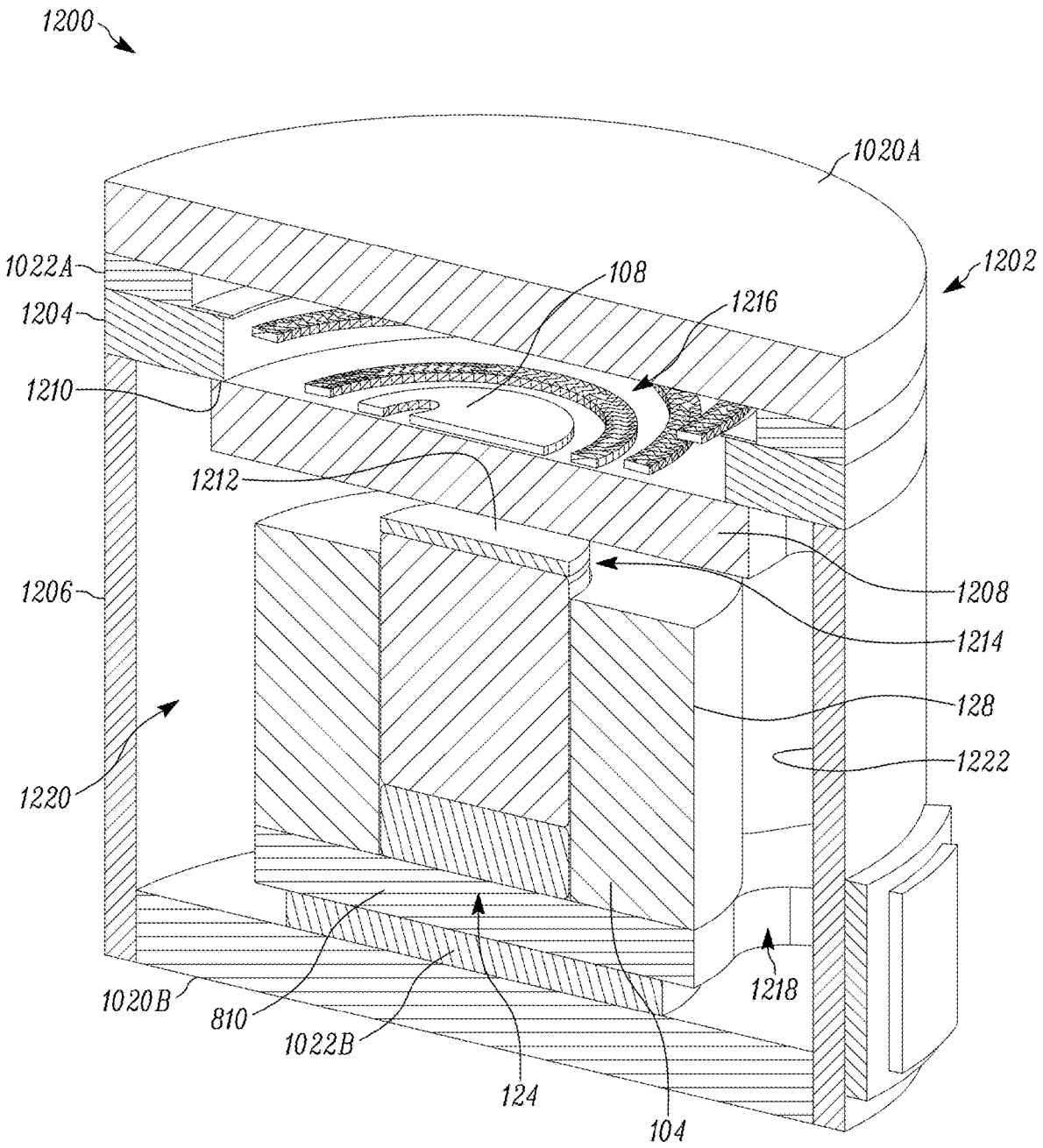
FIG. 12 is a cross-sectional view of an acoustic valve.
Figure 13:
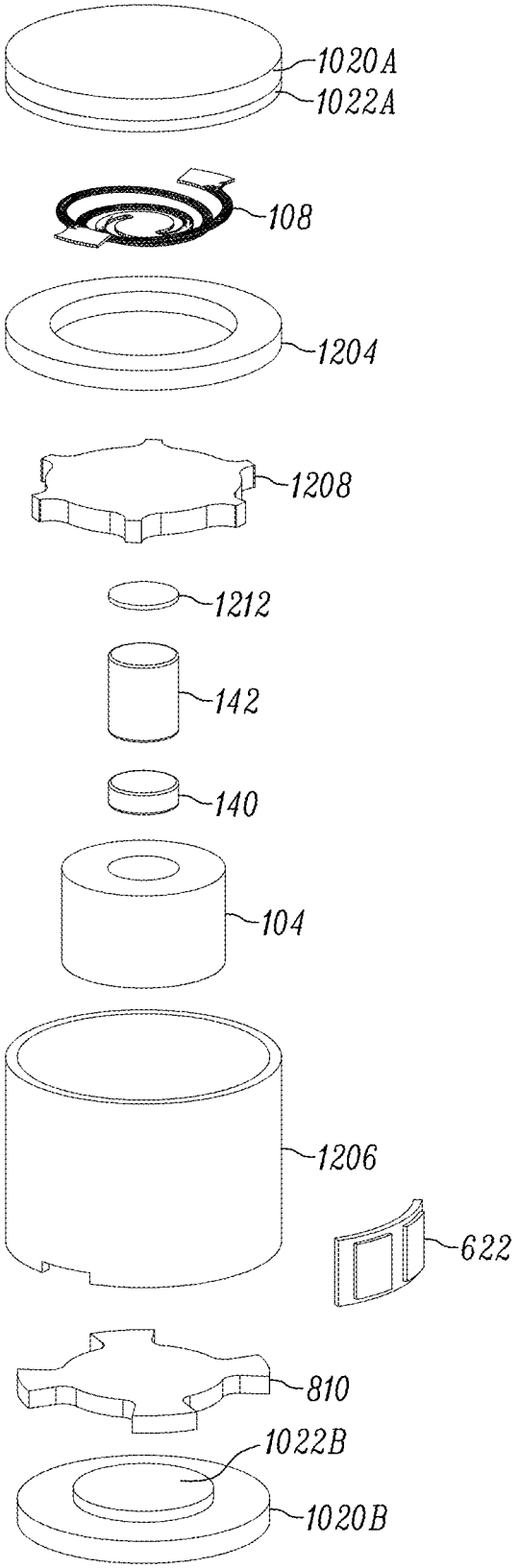
FIG. 13 is an exploded view of the acoustic valve of FIG. 12.

FIGS. 12 and 13 illustrate one example of an acoustic valve 1200 wherein the spring is mounted on the outside of the cover. A housing 1202 of the valve 1200 includes a cover 1204 and a cup. The cup is made of a side piece 1206 and the base piece 810. The cup contains an armature 1208, the coil 104, and the magnetic core 124. The armature 1208 is coupled to the spring 108, and the spring 108 is mounted on the outside of the cover 1204. The armature 1208 is movably disposed between a sealing surface 1210 of the cover 1204 and a stop surface 1212 of a spacer 1214 placed on top of the magnetic core 124. An acoustic inlet 1216 is at least partially defined by the cover 1204, an acoustic outlet 1218 is at least partially defined by the side piece 1206 and the base piece 810, and an acoustic passage 1220 is at least partially defined by the outer surface 128 of the coil 104 and an inner surface 1222 of the side piece 1206. When the valve 1200 is in the open state, the attractive force of the magnetic core 124 exceeds the spring force and holds the armature 1210 against the stop surface 1212 of the spacer 1214. When the valve 1200 is in the closed state, the spring force exceeds the magnetic force and holds the armature 1210 against the sealing surface 1210 of the cover 1204.

Figure 14:
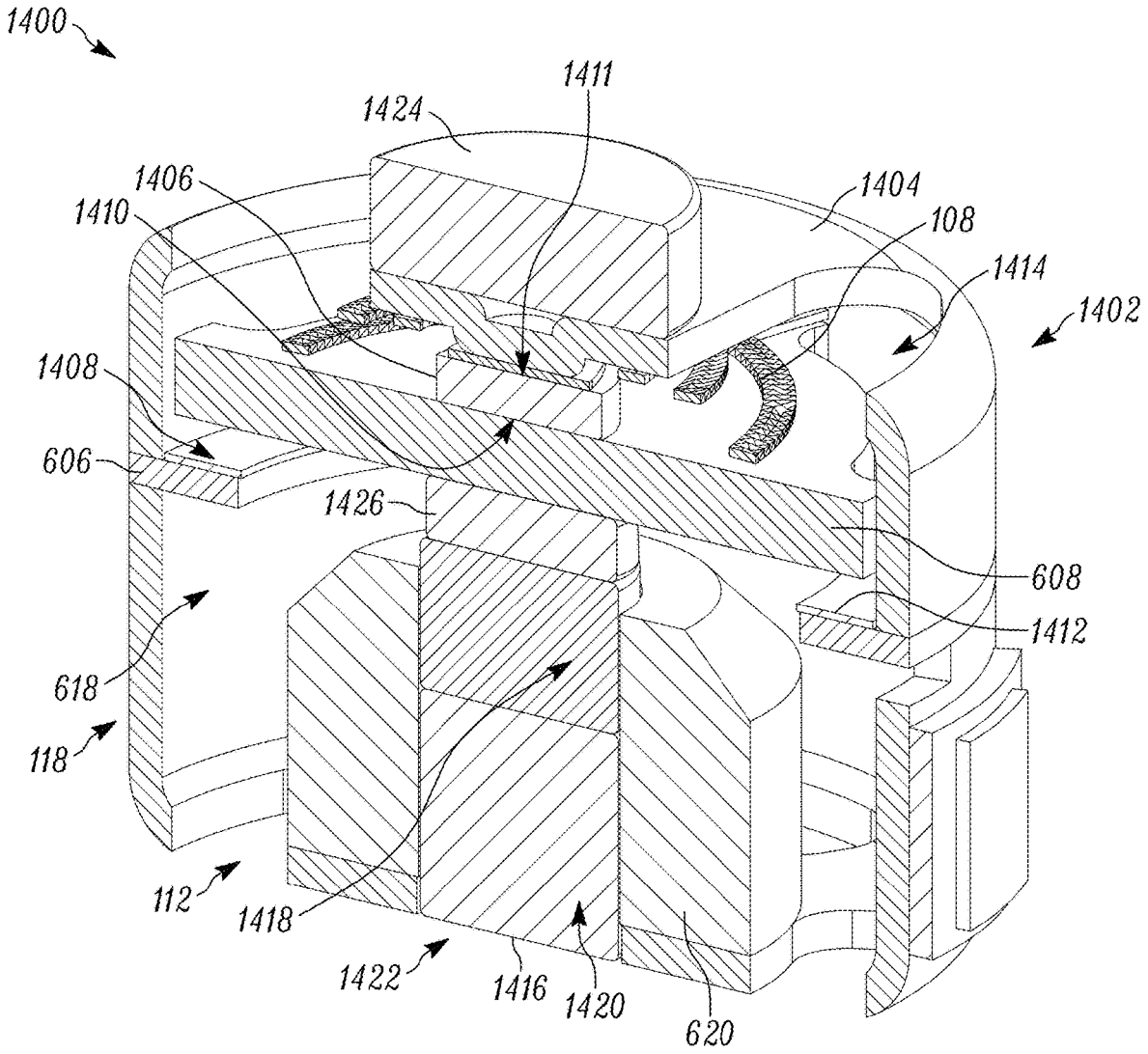
FIG. 14 is a cross-sectional view of an acoustic valve.
Figure 15:
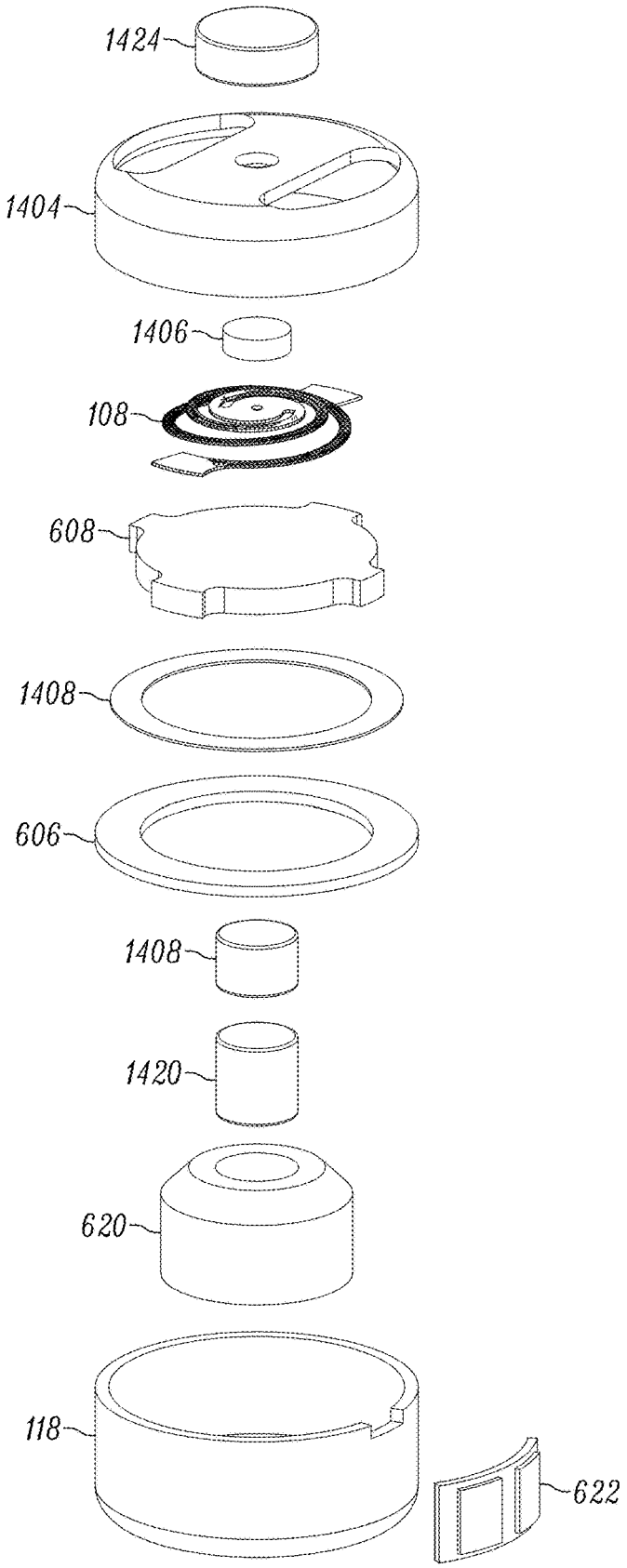
FIG. 15 is an exploded view of the acoustic valve of FIG. 14.

FIGS. 14 and 15 illustrate an acoustic valve 1400 that includes a second magnet on top of the cover as well as a damping material between the ring and the armature, and the cup has a hole for holding the magnetic core. A housing 1402 of the valve 1400 includes a cover 1404, the cup 118, and the ring 606 placed between the cover 1404 and the cup 118. A peripheral portion of the spring 108 is coupled to the armature 608 and a central portion of the spring is attached to the cover 1404. A first damping material 1406 is attached to the spring 108 or to the armature 608. A second damping material 1408 is attached to the ring 606 between the ring and the armature 608. Alternatively, the damping material could be attached to the armature. The armature 608 is movably disposed between a stop surface 1410 of the first damping material 1406 and a sealing surface 1412 of the second damping material 1408. The damping materials are made of shock-absorbent materials such as rubber, foam, or other suitable materials, in order to reduce or otherwise alter the sound made by the armature when the valve changes from one state to another.

An acoustic inlet 1414 is at least partially defined by the cover 1404, and the acoustic passage 618 couples the acoustic inlet 1414 with the acoustic outlet 112. The cup 118 contains the electrical coil 620 disposed about a magnetic core 1416 including a first permanent magnet 1418 and a pole member 1420. The coil is shorter than the magnetic core 1416 to accommodate direct winding in embodiments where the coil is wound directly onto the core. The cup 118 has an aperture 1422 through which the pole member 1420 can be fixed. A second permanent magnet 1424 is disposed on top of the cover 1404 to increase the force exerted on the armature 608 toward the stop surface 1410. As such, when the valve 1400 is in the open state, the upward forces from the spring 108 and the second magnet 1424 exceed the downward force of the core 1422 and hold the armature against the stop surface 1410. When the valve 1400 is in closed state, the force of the magnetic core 1416 exceeds the net force from the spring 108 and the second magnet 1424 and the armature 608 is held against the sealing surface 1412.

Figure 16:
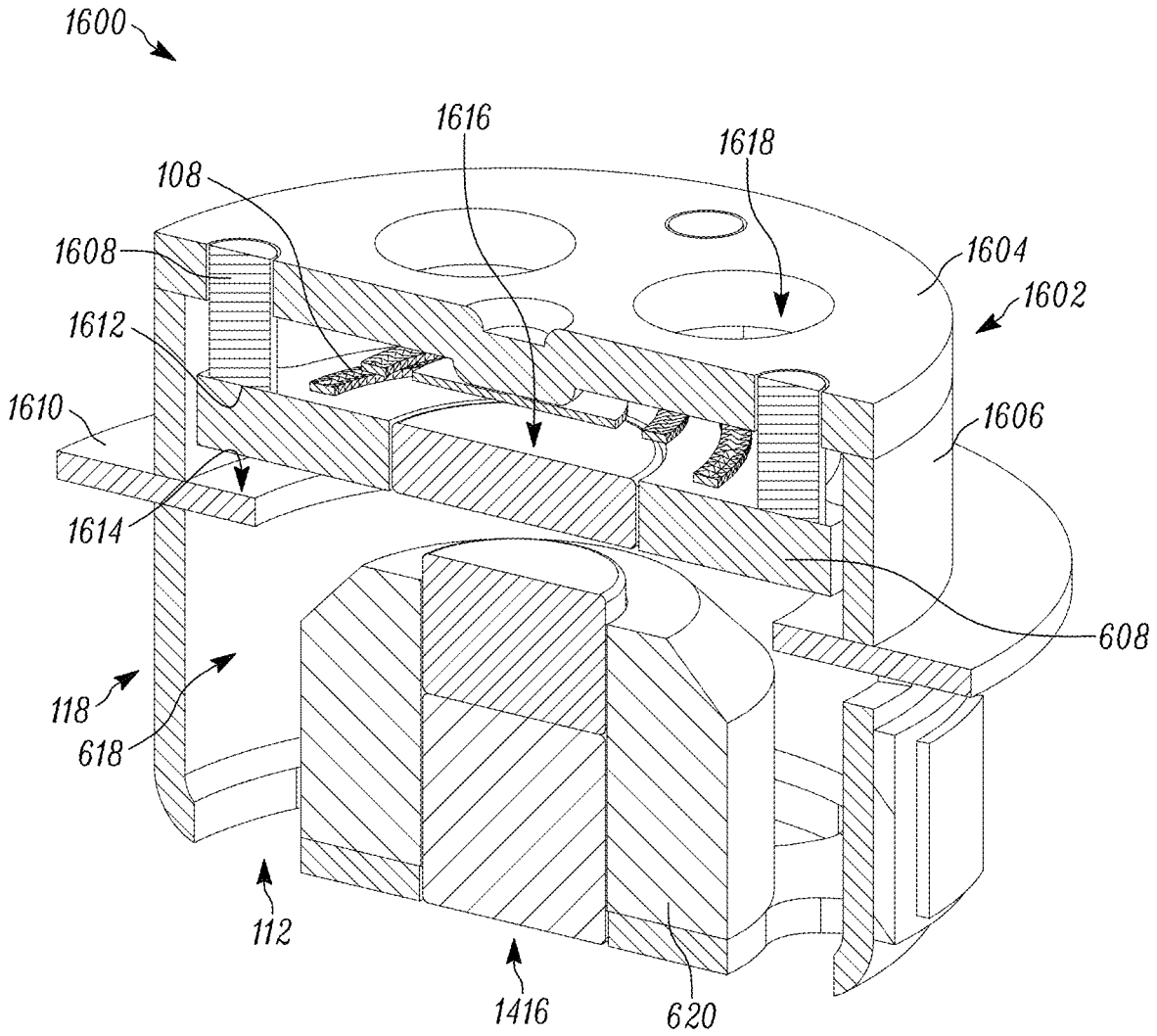
FIG. 16 is a cross-sectional view of an acoustic valve.
Figure 17:
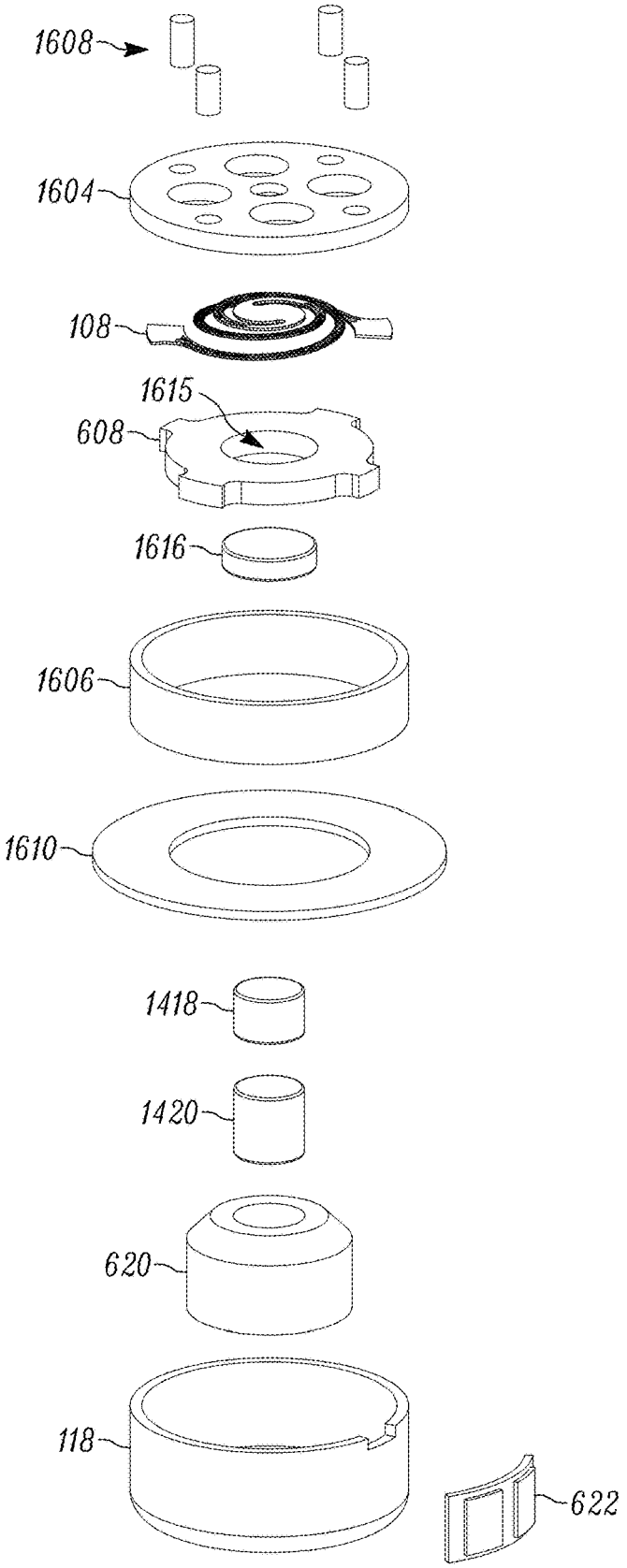
FIG. 17 is an exploded view of the acoustic valve of FIG. 16.

FIGS. 16 and 17 illustrate one example of an acoustic valve 1600 wherein the ring extends radially outwardly of the housing, the valve has a second magnet attached to the armature, and a two-piece cover attracts to the moving magnet. A housing 1602 of the valve 1600 includes a cover and the cup 118. The cover includes a top plate 1604 and a side piece 1606. The top plate 1604 has a plurality of apertures through which rods 1608 are inserted. The cup 118 contains the electrical coil 620 and the magnetic core 1416. Between the side piece 1606 and the cup 118 is a ring 1610 which protrudes from the outer surface of the valve 1600 to make an axial mounting surface for assembly or integration in another device. The armature 608 is movably disposed between a stop surface 1612 of the rods 1608 and a sealing surface 1614 of the ring 1610. The armature 608 has an aperture 1615 in the center where a second permanent magnet 1616 is optionally inserted and fastened to the armature 608. The top plate 1604 is made of a ferromagnetic material to exert a magnetic force on the magnet 1616. The side piece 1606 is made of non-magnetic material such as stainless steel. An acoustic inlet 1618 is at least partially defined by the top plate 1604.

In FIG. 16, when the valve 1600 is in the open state, the spring force biases the armature 608 against the stop surface 1612. When the valve 1600 is in the closed state, the magnetic core 1416 biases the armature 608 against the sealing surface 1614 through interaction with the magnet 1616. As such, in one example, the armature can be made of a non-magnetic material such plastic, stainless steel, or other suitable material because the second magnet 1616 interacts with the magnetic field generated by the magnetic core 1416 and the coil 620 when the coil is energized. In another example, the magnetic core can be made entirely of ferromagnetic material without including any permanent magnet. In yet another example, the armature 608 may be made of ferromagnetic material and the magnet 1616 may be a permanent magnet or a hard ferromagnetic material with a high coercive force.

Figure 18:
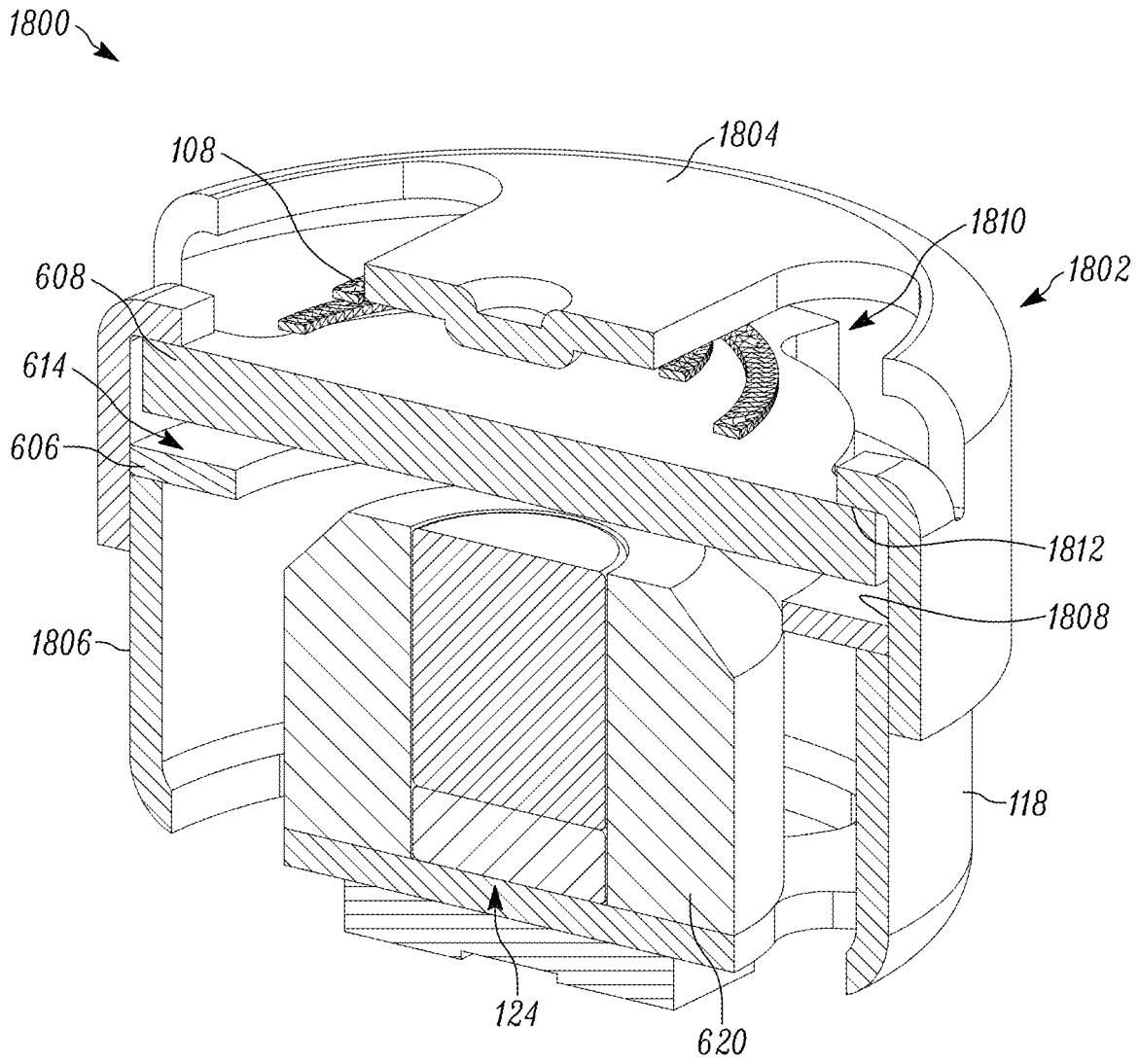
FIG. 18 is a cross-sectional view of an acoustic valve.
Figure 19:
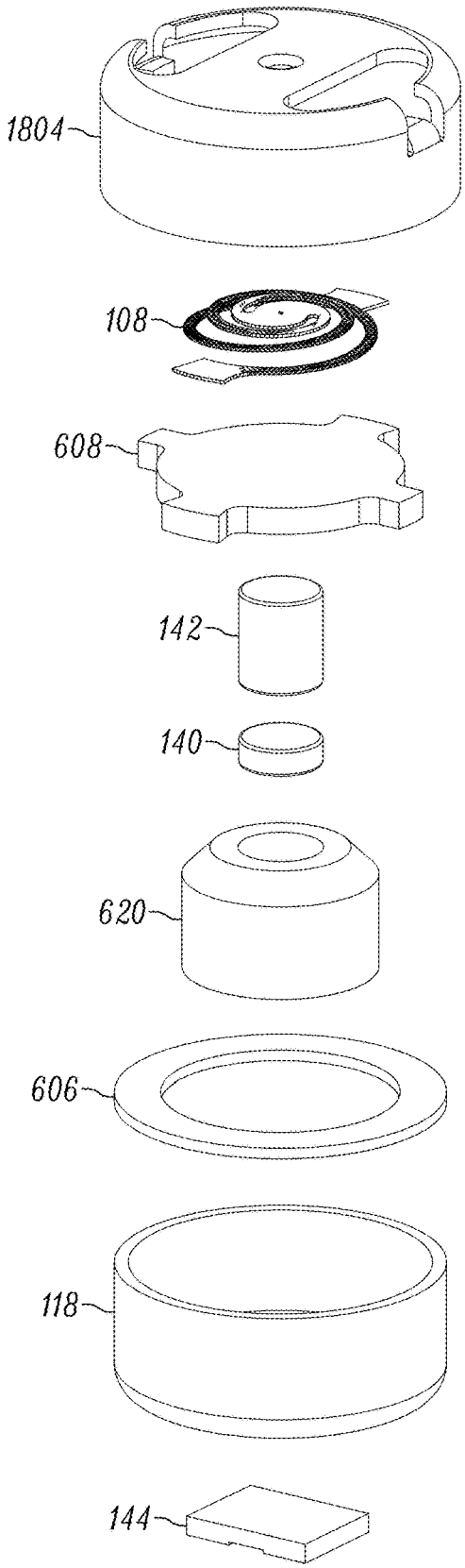
FIG. 19 is an exploded view of the acoustic valve of FIG. 18.

FIGS. 18 and 19 illustrate an acoustic valve 1800 comprising a housing 1802 formed by a cover 1804 and the cup 118 designed such that the outer surface 1806 of the cup falls inside the inner surface 1808 of the cover allowing the cover to slide over the cup during assembly. The sliding assembly of the cover and cup permits precise assembly of the parts. An acoustic inlet 1810 is at least partially defined by the cover 1804. The spring 108 coupled to the armature 608 is also coupled to the cover 1804. When the valve 1800 is in the open state, the spring force is greater than the magnetic force acting on the armature and the spring holds the armature against a stop surface 1812 of the cover 1804. When the valve 1800 is in the closed state, the magnetic force from the magnetic core 124 inside the electrical coil 620 is greater than the spring force acting on the armature and the magnetic force holds the armature against the sealing surface 614 of the ring 606.

Figure 20:
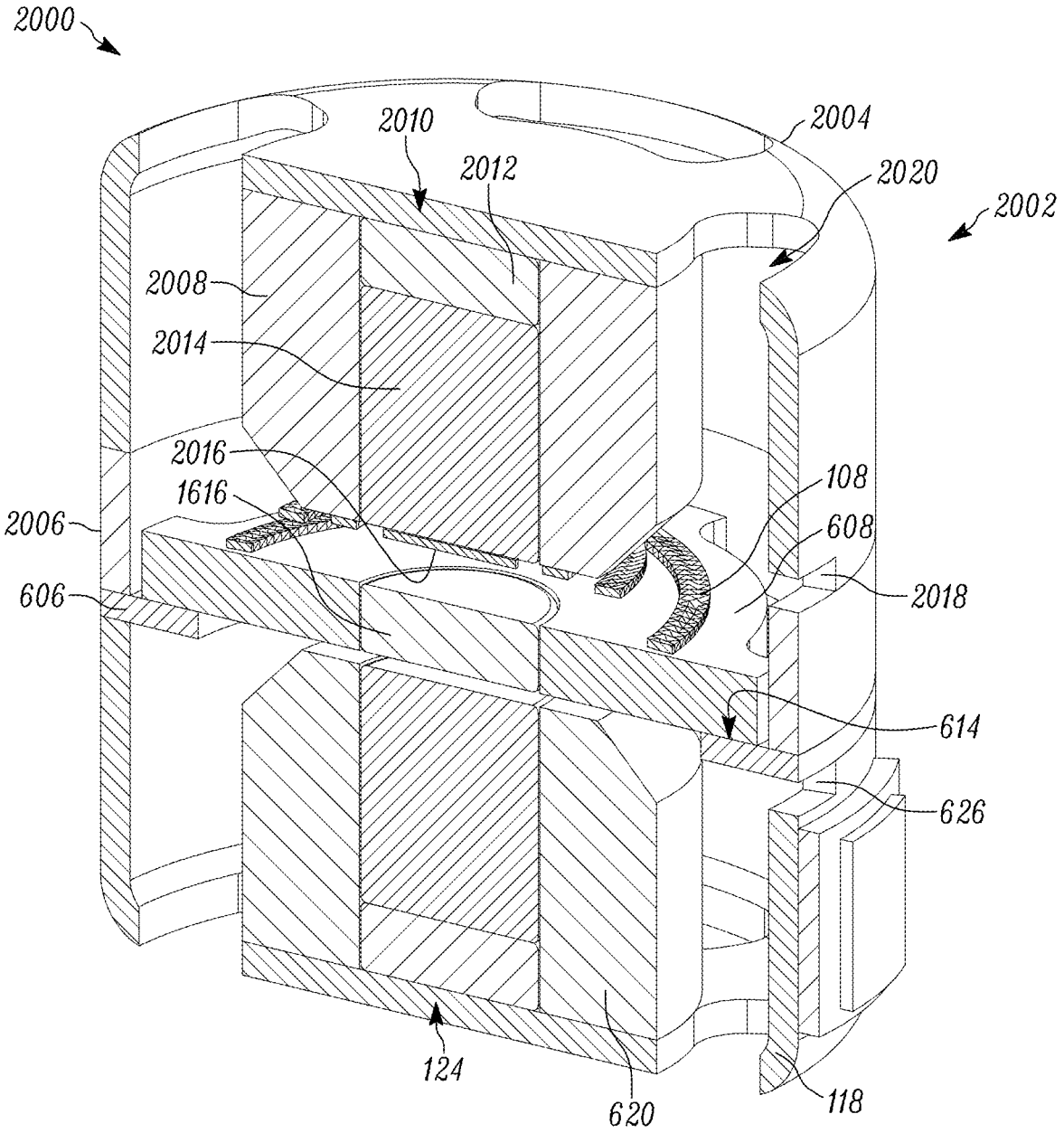
FIG. 20 is a cross-sectional view of an acoustic valve.
Figure 21:
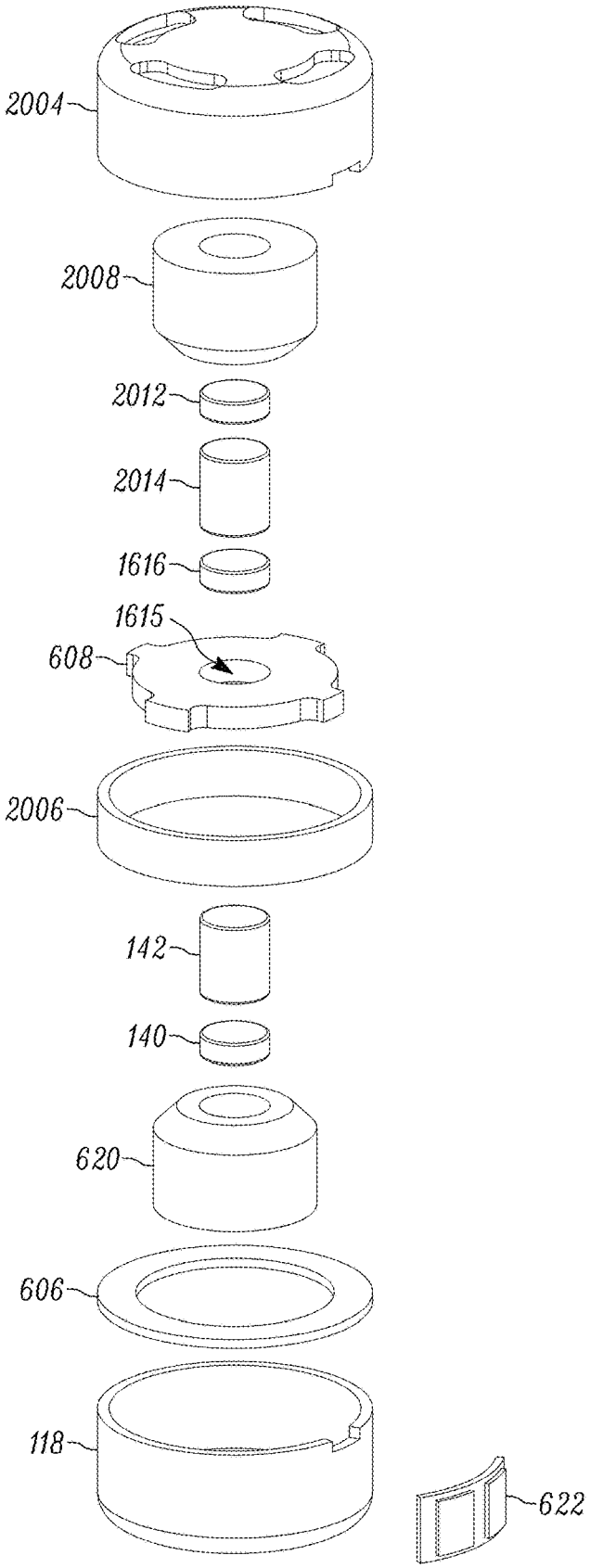
FIG. 21 is an exploded view of the acoustic valve of FIG. 20.

FIGS. 20 and 21 illustrate an acoustic valve 2000 comprising a housing 2002 formed by a bottom cup 118 and a top cup 2004, as well as a cylindrical spacer 2006 and ring 606 disposed between the bottom cup and the top cup. Attached inside the bottom cup are the first electrical coil 620 and the first magnetic core 124 in the center of the first coil. Similarly, attached inside the top cup 2004 are a second electrical coil 2008 and a second magnetic core 2010 in the center of the second coil. The spring 108 coupled to the armature 608 attaches to the second magnetic core 2010. The armature 608 has a second permanent magnet 1616 inserted and fixed inside an aperture in the center. The second magnetic core 2020 includes a third permanent magnet 2012 and a second pole piece 2014.

The strength of the magnetic force exerted by each of the three magnets can be selected such that, when the valve 2000 is in the open state, the total magnetic force as well as the tension force exerted by the spring 108 holds the armature 608 against a stop surface 2016 of spring 108, and when the valve 2000 is in the closed state, the armature is held against the sealing surface 614 of the ring 606. Alternatively, the spring 108 functions primarily to locate the armature in the housing while applying minimal axial tension on the armature. The cups 118 and 2004 as well as the cylindrical spacer 2006 can be made of non-magnetic materials such as stainless steel or other suitable materials or may be made of ferromagnetic material. A set of wires (not shown) extends from each of the coils 620 and 2008 to the terminal board 622. In the bottom cup 118, the wires pass through the cut 626 in the cup 118, and likewise in the top cup 2004, the wires pass through a cut 2018 in the top cup 2004. The top cup 2004 at least partially defines an acoustic inlet 2020.

In FIGS. 20 and 21, a magnet is disposed on each side of the armature as well as inside the armature. The spring 108 primarily laterally constrains the armature. In another embodiment, the spring exerts tension in one state and compression in the other state, applying approximately equal but opposite forces in the open and closed states of the valve. In yet another example, the number of magnets involved can be reduced to two or one. For example, there can be magnets in both of the first and second magnetic cores and no magnet in the armature, or there can be a magnet in just the armature and not in any of the magnetic cores. Both magnetic cores 2010 and 124 may be entirely permanent magnet, entirely soft ferromagnetic material with a low coercive force, or entirely ferromagnetic material with a high coercive force that is magnetically charged. Furthermore, both of the first and second magnetic coils can operate simultaneously to produce magnetic field, or the electrical control unit can be designed to energize only one coil at a time, as appropriate.

Figure 22:
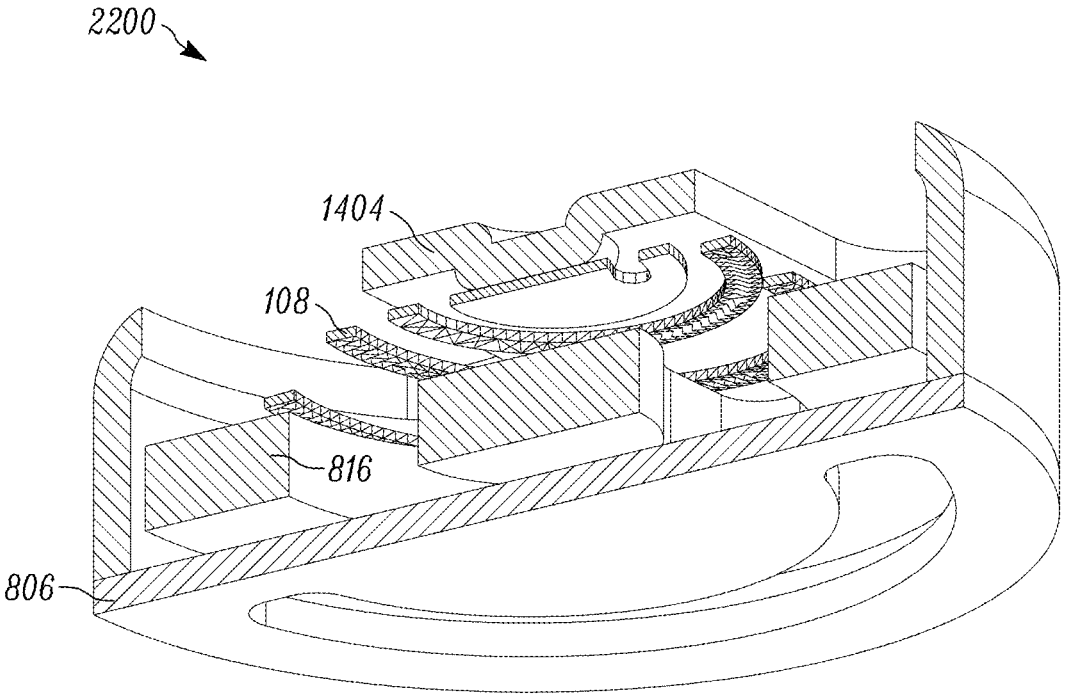
FIG. 22 is a cross-sectional view of a portion of an acoustic valve housing.
Figure 23:
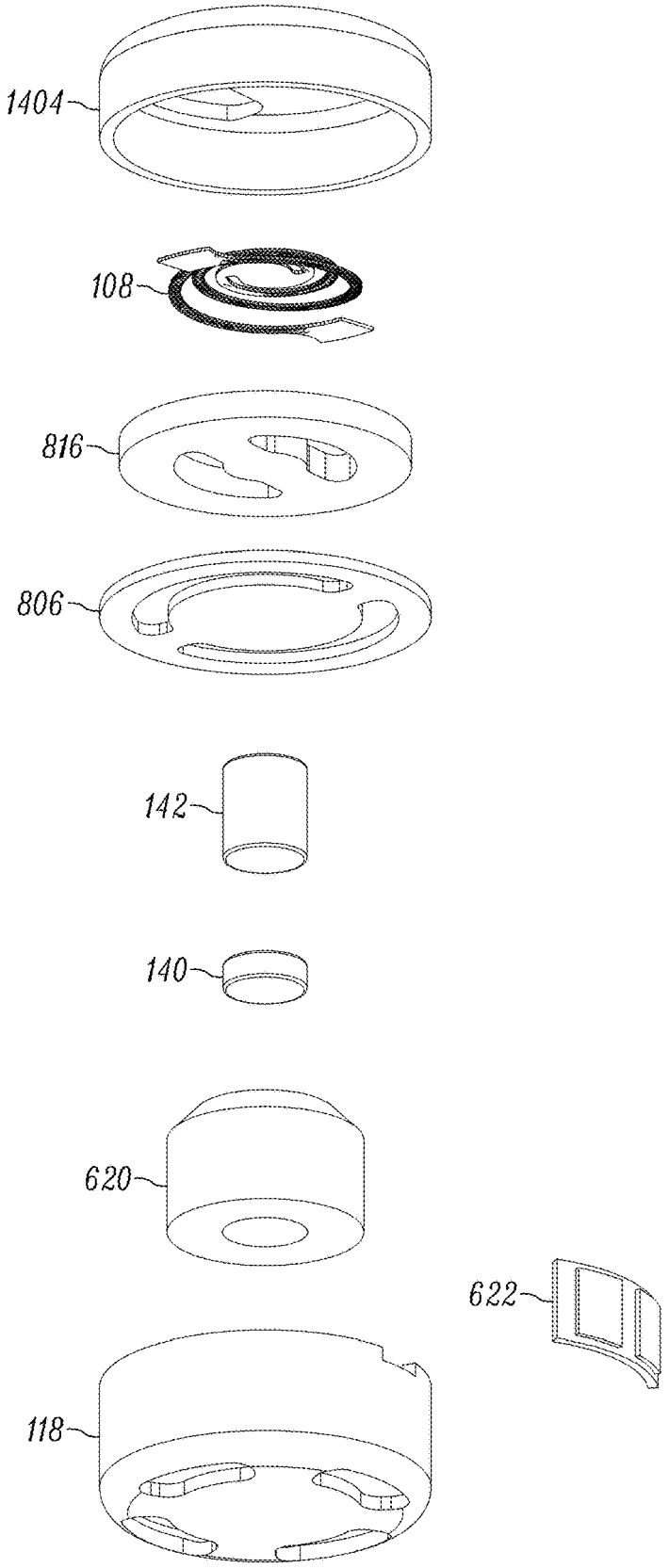
FIG. 23 is an exploded view of an acoustic valve using the portion of the housing of FIG. 22.

FIG. 22 is an alternative design for the top half portion of an acoustic valve housing 2200 and FIG. 23 is an acoustic valve using the top half portion of the acoustic valve housing 2200 of FIG. 22. In FIG. 22, the housing 2200 includes the cover 1404, the spring 108, the armature 816, and the spacer 806 from the previous examples. However, the armature 816 is devoid of the radial arms disclosed in other embodiments described herein. This portion of the housing 2200 can be used alternatively with the cup, coil, and magnetic core of any of the previously described embodiments.

Figure 24:
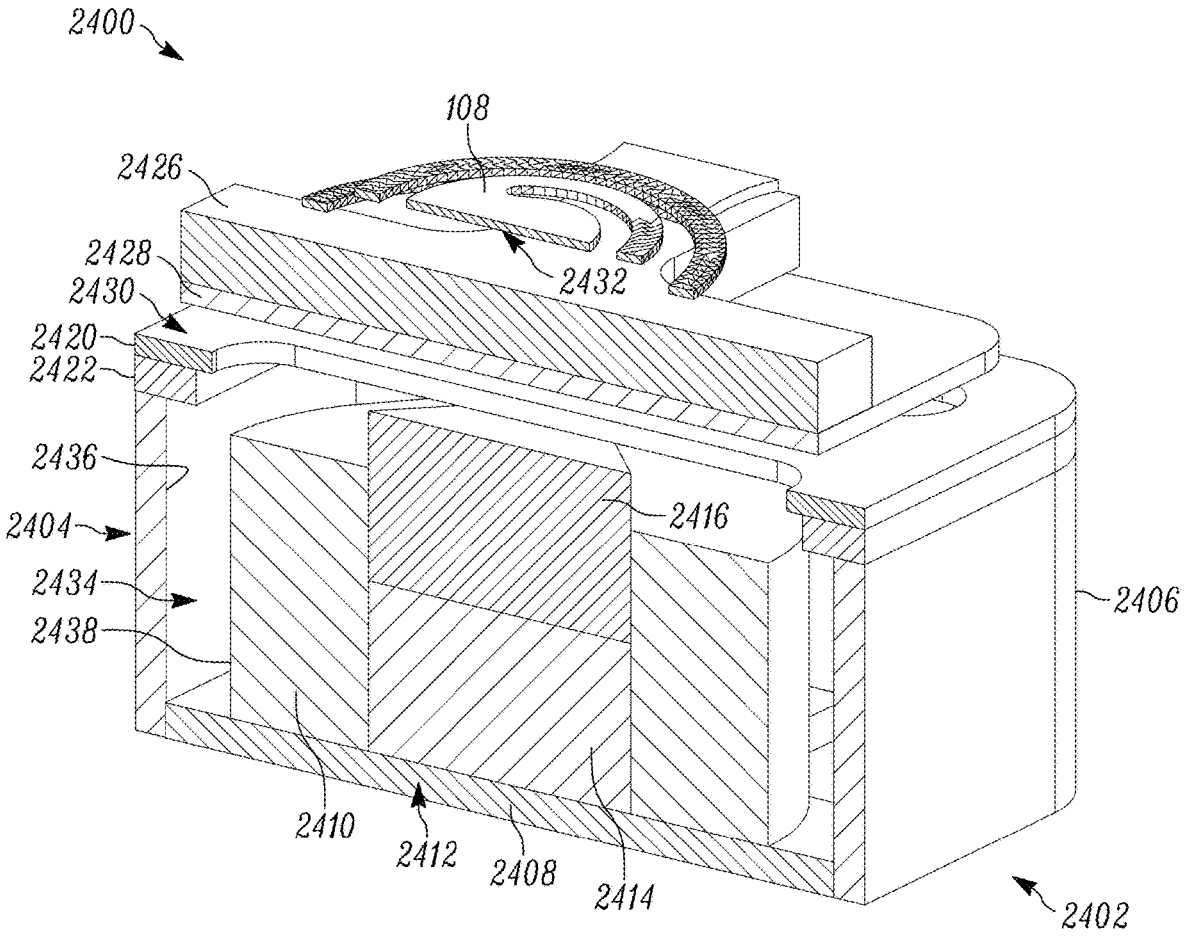
FIG. 24 is a cross-sectional view of a portion of an acoustic valve.
Figure 25:
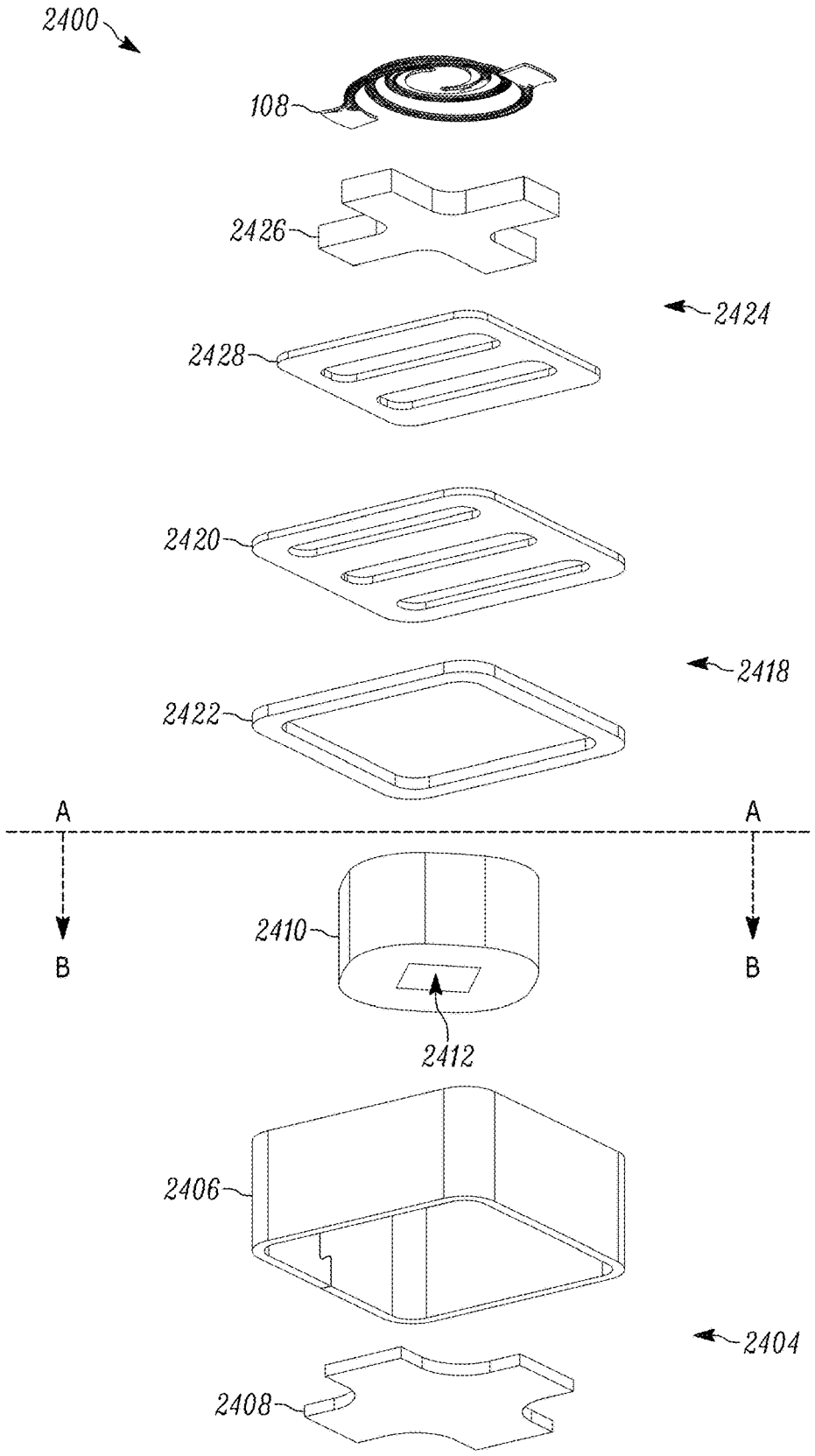
FIG. 25 is an exploded view of the acoustic valve of FIG. 24.
Figure 26:
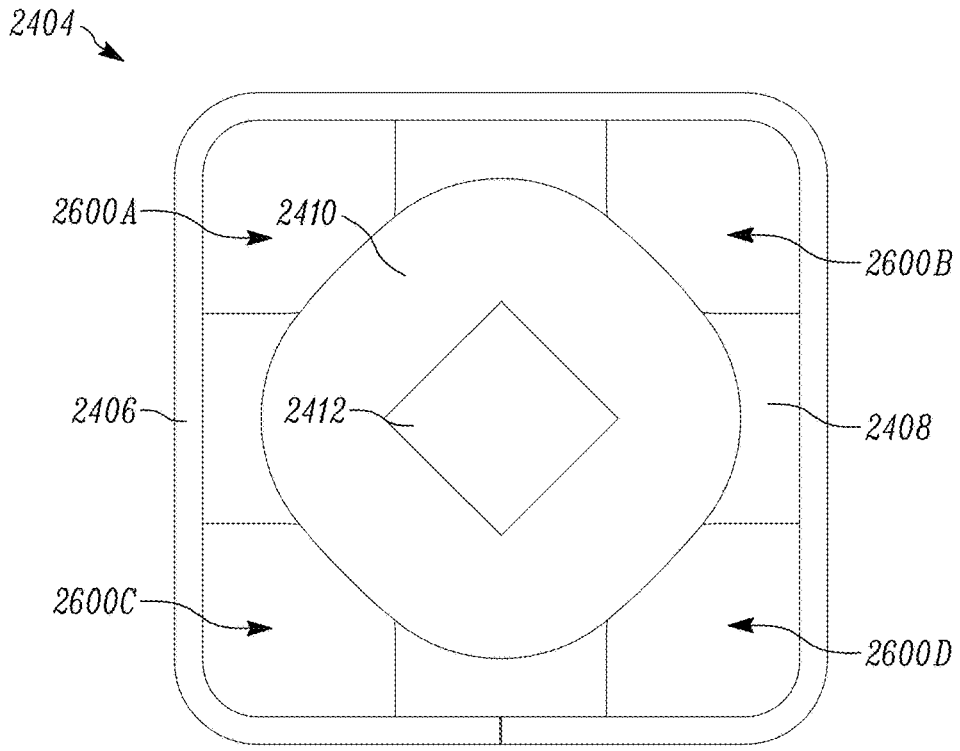
FIG. 26 is a top view of a partially assembled acoustic valve of FIG. 25 viewed at line A-A in the direction of the arrow B.

FIGS. 24 to 26 illustrate an acoustic valve 2400 wherein the cup has a square or rectangular sectional shape and includes a plurality of components for assembly, the armature and the ring each have two components, and the core and the coil are also square or rectangular in form. A housing 2402 includes a cover (not shown) of any suitable structure and a cup 2404. The cup 2404 includes a side piece 2406 and a base piece 2408. The side piece can be made of a plurality of components that can be combined together during assembly, for example by using a dovetail stitching design in the components that make up the side piece. The cup 2404 is rectangular in structure, which allows for more surfaces to mount a terminal board (not shown), easier assembly into a hearing device, and less acoustic impedance in the open state of the valve 2400.

In FIG. 24, the cup 2404 contains an electrical coil 2410 and a magnetic core 2412 attached to a base 2408, where the magnetic core 2412 includes a permanent magnet 2414 and a pole piece 2416 configured as described herein. The coil 2410 and the core 2412 are also rectangular in structure and cross section, which may be more cost effective in manufacturing and allows for a wider acoustic outlet 2600 in the rectangular-structured cup 2404, as illustrated in FIG. 26. The acoustic outlet 2600 is at least partially defined by the cup 2404 and the coil 2410 of the valve 2400. An acoustic passage 2434, at least partially defined by an inner surface 2436 of the side piece 2404 and an outer surface 2438 of the coil 2410, is located substantially adjacent to the edges of the cup 2404.

In FIGS. 24 and 25, a two-piece ring 2418 attaches to the top of the cup 2404, where the two-piece ring 2418 is made of a first sealing piece 2420 and a bottom ring piece 2422. The bottom ring piece 2422 is designed to be thicker than the first sealing piece 2420 and can be made of a ferromagnetic material to improve electromagnetic performance of the valve and provide structural support for the housing. A two-piece armature 2424 is made of a top armature piece 2426 and a second sealing piece 2428, and the top armature piece 2426 couples to the spring 108. The spring 108 is attached to a portion of the cover. The top armature piece 2426 is designed to be thicker than the second sealing piece 2422 and is made of ferromagnetic material to increase stiffness, improve magnetic efficiency of the valve, and provide protection against any shock coming from the sidewalls of the cover (not shown).

When the valve 2400 is in the closed state, the magnetic force exceeds the spring force acting on the armature and the magnet holds the second sealing piece 2428 of the armature 2424 against a sealing surface 2430 of the first sealing piece 2420. The sealing pieces support finer features, and either one or both of the two sealing pieces 2420 and 2428 can be made of soft material to reduce sound made when the valve enters the closed state. When the valve 2400 is in the open state, the spring force exceeds the magnetic force acting on the armature and the spring holds armature piece 2426 against a stop surface of the cover (not shown).

Figure 27:
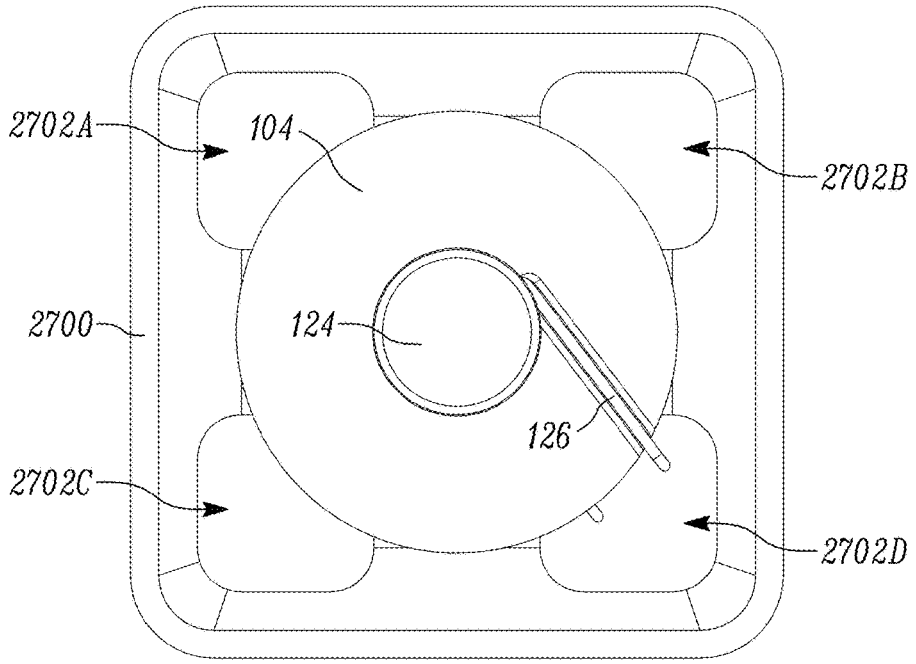
FIG. 27 is a top view of an alternative design for the partially assembled acoustic valve of FIG. 26.

FIG. 27 is an alternative design for the rectangular-structured cup 2404, coil 2410, and magnetic core 2412 disclosed in FIG. 26 using the circular electrical coil 104 and the circular magnetic core 124. A one-piece rectangular cup 2700 replaces the cup 2404, and similarly, the circular electrical coil 104 and the circular magnetic core 124 replaces the rectangular electrical coil 2410 and the rectangular magnetic core 2412, respectively. Other combinations of the aforesaid cup, coil, and magnetic core can be utilized, as appropriate. An acoustic outlet 2702 is at least partially defined by the cup 2700 and the coil 104. Furthermore, while the housing, cup, coil, and magnetic core disclosed above are circular or rectangular in structure or cross section, it should be noted that any other suitable polygonal structure and cross section can be utilized, as deemed appropriate.

In all of the embodiments described herein, one or more of the stops, stop or sealing surfaces or armature can be coated or covered with, or constructed from, a material that alters, dampens or otherwise reduces any noise that may occur when the armature changes state. Thus in FIGS. 1-2 and 4-25, for example, a compliant material may be disposed between the armature and the stop or sealing surface. The compliant material may be attached to, or integrally formed with, either the armature or stop or surface thereof or with both components. As suggested, the compliant material may be made integral to one or more of these parts or it may be a separate part or coating applied thereto as described herein.

In some embodiments, a ferrofluid is used as a damping mechanism between the armature and one or both the stops to reduce audio artifacts when the valve changes states. A ferrofluid is a magnetic material (e.g., dust, shavings, etc.) suspended in a viscous fluid like oil. In some embodiments, the ferrofluid is located proximate a permanent magnetic material such that the ferrofluid is within any suitable distance from the permanent magnetic material for the permanent magnetic material to exert magnetic effect on the ferrofluid. In FIG. 14, for example, a ferrofluid 1426 could be disposed between the magnetic core 1416 and the armature 608, wherein the magnetic field of the core captures the ferrofluid between the armature and the end of the magnetic core. A ferrofluid 1406 could also be disposed between the armature 608 and the cover 1404 as an alternative to ferrofluid 1426 or in addition thereto. A permanent magnetic material disposed on the stop portion of the cover 1402 or integrated with the armature will capture the ferrofluid 1406 between the armature and the stop. According to this alternative embodiment, 1406 is the ferrofluid and 1411 is a magnetic material fastened to the cover 1404. In FIG. 16, a ferrofluid could be disposed between the magnetic core 1416 and the armature magnet 1616. Ferro fluid could also be disposed between the armature magnet 1616 and the cover 1604. In this alternative embodiment of FIG. 16, the spacings between the armature, core and cover would need to be aligned with the stops 1614 and 1612 with some space accommodation for the ferrofluid. Ferrofluid could be similarly disposed on at least one side of the armature in the embodiments of FIGS. 1, 4, 6, 10, 12, 18, 20 and 22.

While the present disclosure and what is presently considered to be the best mode thereof has been described in a manner that establishes possession by the inventors and that enables those of ordinary skill in the art to make and use the same, it will be understood and appreciated that in light of the description and drawings there are many equivalents to the exemplary embodiments disclosed herein and that myriad modifications and variations may be made thereto without departing from the scope and spirit of the disclosure, which is to be limited not by the exemplary embodiments but by the appended claimed subject matter and its equivalents.

The invention claimed is:

1. An acoustic valve comprising:

a housing having an acoustic inlet, an acoustic outlet, and an acoustic passage between the inlet and the outlet;

an electrical coil disposed in the housing and configured to generate a magnetic field when the electrical coil is energized by an actuation signal;

an armature movably disposed in the housing between a first surface and a second surface, the first or second surface having at least one opening therethrough which at least partially defines the acoustic passage, a spring coupled to the armature;

the valve having a first stable state wherein the armature is positioned against the first surface when the electrical coil is not energized, and the valve having a second stable state wherein the armature is positioned against the second surface when the electrical coil is not energized, the first surface and the second surface are on opposite sides of the armature, the armature movable between the first stable state and the second stable state when the electrical coil is energized, wherein the acoustic passage is more obstructed when the armature is in one of the first stable state or second stable state than when the armature is in the other of the first stable state or the second stable state.

2. The acoustic valve of claim 1 further comprising a magnetic core disposed at least partially in a passage of the coil, the spring is pre-loaded when the armature is in both the first stable state and the second stable state.

3. The acoustic valve of claim 2, the spring and electrical coil are on opposite sides of the armature, wherein the spring applies a spring force to the armature and the magnetic core applies a magnetic force to the armature, the magnetic force opposite the spring force, wherein the magnetic force exceeds the spring force when the armature is in one of the first stable state or the second stable state and the spring force exceeds the magnetic force when the armature is in the other of the first stable state or the second stable state.

4. The acoustic valve of claim 3, wherein the armature is positioned closer to the electrical coil when the armature is in one of the first stable state or second stable state and the armature is positioned farther from the electrical coil when the armature is in the other of the first stable state or the second stable state.

5. The acoustic valve of claim 4, wherein the acoustic passage is more obstructed when the armature is positioned closer to the electrical coil and the armature is positioned against the first surface or the second surface.

6. The acoustic valve of claim 5 further comprising a stationary magnet spaced apart from the magnetic core and located on the same side of the armature as the spring, wherein the stationary magnet applies a magnetic force to the armature in a first direction.

7. The acoustic valve of claim 4, wherein the acoustic passage is more obstructed when the armature is positioned farther from the electrical coil and the armature is positioned against the first surface or the second surface.

8. The acoustic valve of claim 2, the spring and electrical coil are on a common side of the armature, wherein the spring applies a spring force to the armature and the magnetic core applies a magnetic force to the armature in a direction opposite the direction of the spring force, wherein the magnetic force dominates the spring force when the armature is in one of the first stable state or the second stable state and the spring force dominates the magnetic force when the armature is in the other of the first stable state or the second stable state.

9. The acoustic valve of claim 2, the armature is positioned closer to the electrical coil when the armature is in one of the first stable state or second stable state and the armature is positioned farther from the electrical coil when the armature is in the other of the first stable state or the second stable state, wherein the acoustic passage is more obstructed when the armature is positioned closer to the electrical coil and the armature is positioned against the first surface or the second surface.

10. The acoustic valve of claim 2, the armature is positioned closer to the electrical coil when the armature is in one of the first stable state or second stable state and the armature is positioned farther from the electrical coil when the armature is in the other of the first stable state or the second stable state, wherein the armature is positioned against the first surface or the second surface and the acoustic passage is more obstructed when the armature is positioned away from the electrical coil.

11. The acoustic valve of claim 2, wherein the acoustic passage is at least partially defined by a volume located between an outer surface of the electrical coil and an inner surface of the housing.

12. The acoustic valve of claim 11, wherein housing has a substantially polygonal cross section and the volume is located substantially adjacent to the edges of the housing.

13. The acoustic valve of claim 2, wherein magnetic core has a polygonal cross section.

14. The acoustic valve of claim 2 in combination with a hearing device including a sound-producing electro-acoustic transducer and a sound output coupled to an ear tip, the acoustic valve disposed in an acoustic passage of the hearing device, wherein actuation of the acoustic valve controls aid flow through the acoustic passage.

15. The acoustic valve of claim 2 further comprising a ferrofluid disposed between the armature and the magnetic core, wherein the ferrofluid reduces audio artifacts when the valve changes states.

16. The acoustic valve of claim 2 further comprising a ferrofluid disposed between the armature and the first surface or the second surface, and a magnetic material proximate the ferrofluid, wherein the ferrofluid reduces audio artifacts when the valve changes states.

17. The acoustic valve of claim 1, wherein a gap between a sidewall of the housing and the armature is sized to prevent straining the spring upon displacement of the armature toward the sidewall.

18. The acoustic valve of claim 1, wherein the acoustic passage is at least partially defined by a volume located between an outer surface of the electrical coil and an inner surface of the housing.

19. The acoustic device of claim 1 further comprising a magnet coupled to the armature, wherein the magnet applies a force to the armature in a first direction in either the first or second stable state and the magnet applies a force to the armature in a second direction in the other of the first or second stable state, wherein the first direction is opposite the second direction, wherein the spring and electrical coil are located on opposite sides of the armature.

20. The acoustic device of claim 1 further comprising a magnet coupled to the armature, wherein the magnet applies a force to the armature in a first direction in either the first or second stable state and the magnet applies a force to the armature in a second direction in the other of the first or second stable state, wherein the first direction is opposite the second direction, wherein the spring and electrical coil are located on a common side of the armature.

* * * * *